US012490843B2

(12) United States Patent
Malone

(10) Patent No.: US 12,490,843 B2
(45) Date of Patent: Dec. 9, 2025

(54) STACKABLE PICTURE FRAME FOR COLLAGE

(71) Applicant: Artabee IP Holdings, LLC, Lafayette, CO (US)

(72) Inventor: Jomana Malone, Lafayette, CO (US)

(73) Assignee: Artabee IP Holdings, LLC, Lafayette, CO (US)

( * ) Notice: Subject to any disclaimer, the term of this patent is extended or adjusted under 35 U.S.C. 154(b) by 74 days.

(21) Appl. No.: 18/440,279

(22) Filed: Feb. 13, 2024

(65) Prior Publication Data

US 2024/0285102 A1 Aug. 29, 2024

Related U.S. Application Data

(60) Provisional application No. 63/487,159, filed on Feb. 27, 2023.

(51) Int. Cl.
*A47G 1/06* (2006.01)

(52) U.S. Cl.
CPC ..... *A47G 1/065* (2013.01)

(58) Field of Classification Search
CPC ..... A47G 1/065
See application file for complete search history.

(56) References Cited

U.S. PATENT DOCUMENTS

| | | | | |
|---|---|---|---|---|
| D40,994 S | | 11/1910 | Foster | |
| D59,938 S | | 12/1921 | Sobczak | |
| D186,114 S | | 9/1959 | Church | |
| 3,070,914 A | | 1/1963 | Henderson et al. | |
| 3,471,959 A | | 10/1969 | Seger | |
| 3,523,382 A | | 8/1970 | Dreyer | |
| 3,593,064 A | | 7/1971 | Horst | |
| 3,673,723 A | * | 7/1972 | Lazar | A47G 1/065 40/729 |

(Continued)

FOREIGN PATENT DOCUMENTS

| | | |
|---|---|---|
| DE | 2059244 A1 | 12/1970 |
| EP | 0087624 A2 | 2/1983 |

OTHER PUBLICATIONS

Etsy, https://web.archive.org/web/20200810122158/https://www.etsy.com/listing/175663900/4x6-picture-frame-made-with-red-green, Aug. 10, 2020. (Year: 2020).*

(Continued)

*Primary Examiner* — Gary C Hoge
(74) *Attorney, Agent, or Firm* — Trenner Law Firm LLC; Mark Trenner

(57) ABSTRACT

A stackable picture frame device is disclosed as it may include a first frame body and a second frame body. Each of the first frame body and the second frame body have an outside perimeter forming a boundary, and an interior area defined by an inside perimeter of the respective frame body. The interior area may be for displaying a photograph or artistic work. Substantially equally spaced projections are formed on a front face of each frame body, and substantially equally spaced cavities are formed on a back face of each frame body corresponding to the projections formed on the front face of each frame body. The projections formed on the front face of the first frame body are sized to fit within any of the cavities formed on the back face of the second frame body to connect the frame bodies and form a collage.

20 Claims, 23 Drawing Sheets

(56) References Cited

U.S. PATENT DOCUMENTS

| | | | | |
|---|---|---|---|---|
| 3,722,122 | A * | 3/1973 | Sesto | A47G 1/065 428/14 |
| 3,879,873 | A | 4/1975 | Sawyer | |
| 4,017,989 | A * | 4/1977 | Murray | G09F 1/12 40/605 |
| 4,115,938 | A | 9/1978 | Belmuth et al. | |
| 4,123,862 | A | 11/1978 | Dyer et al. | |
| 4,458,873 | A | 7/1984 | Sutherland | |
| 4,608,770 | A | 9/1986 | Gray | |
| 4,777,067 | A | 10/1988 | Woronow et al. | |
| 5,020,251 | A * | 6/1991 | Cheng | A47G 1/065 40/748 |
| 5,243,777 | A | 9/1993 | Dedlow | |
| 5,267,403 | A | 12/1993 | Hesner | |
| D345,541 | S | 3/1994 | Schmitz | |
| 5,443,545 | A | 8/1995 | Weber | |
| D368,117 | S | 3/1996 | Vails et al. | |
| D370,353 | S | 6/1996 | Vails et al. | |
| 5,588,240 | A | 12/1996 | Zilliox | |
| 5,761,839 | A | 6/1998 | Heikkila | |
| 5,826,394 | A | 10/1998 | Barton et al. | |
| D403,166 | S | 12/1998 | Parker | |
| 6,054,968 | A | 4/2000 | De Matteo | |
| D424,813 | S | 5/2000 | DeMary | |
| 6,338,215 | B1 * | 1/2002 | Vincent | A47G 1/065 40/729 |
| D464,808 | S | 10/2002 | Martinez | |
| 6,655,064 | B1 | 12/2003 | Dodson | |
| 6,679,780 | B1 | 1/2004 | Shift | |
| D500,089 | S | 12/2004 | Gillard | |
| D500,705 | S | 1/2005 | Huang | |
| D521,916 | S | 5/2006 | Spencer | |
| D529,301 | S | 10/2006 | Phillips | |
| D619,376 | S | 7/2010 | Mischel, Jr. | |
| D623,865 | S | 9/2010 | Winer et al. | |
| 7,802,390 | B2 | 9/2010 | Reis | |
| 8,333,026 | B2 | 12/2012 | Southard | |
| 8,382,548 | B2 | 2/2013 | Maggiore et al. | |
| D726,261 | S | 4/2015 | Uno | |
| 9,370,266 | B2 | 6/2016 | Best et al. | |
| 10,034,562 | B2 | 7/2018 | Kumar | |
| 11,033,124 | B1 | 6/2021 | Stark | |
| 2003/0013374 | A1 | 1/2003 | Lin | |
| 2005/0191932 | A1 | 9/2005 | Lin | |
| 2006/0201039 | A1 | 9/2006 | Gilliland | |
| 2007/0295436 | A1 | 12/2007 | Joseph | |
| 2011/0277364 | A1 | 11/2011 | Smaly et al. | |
| 2014/0047747 | A1 | 2/2014 | Jackson | |
| 2015/0033602 | A1 | 2/2015 | Fuerst | |
| 2016/0309926 | A1 * | 10/2016 | Jhagroo | A47G 1/065 |
| 2016/0345754 | A1 * | 12/2016 | Hogrefe | A47G 1/065 |
| 2017/0367504 | A1 * | 12/2017 | Servutas | G09F 15/0012 |

OTHER PUBLICATIONS

Etsy (Year: 2020).*
Snap-Together Modular Picture Frame_ Printables.
Ebay—DIY Kit For Kids Building Blocks Photo Frame.
Removable decorative doorlite frames and door glass _ Plastpro Inc.
https://www.kickstarter.com/projects/1155321987/fotobit-modular-photo-framing-system.
Dreamstime 3D cubes frame, available Dec. 23, 2011, [online], [site visited Jul. 2, 2015]. Available from internet, <URL: http://www.dreamstime.com/stock-photos-3d-cubes-frame-image1285433.
Mathlink Cubes, available Jul. 27, 2012, [online], [site visited Jul. 2, 2015]. Available from internet, <URL: http://www.amazon.com/Learning-Resources-LER4285-Mathlink-Cubes-100/dp/B000URL296.
PuzzleMad, available Apr. 26, 2012, [online], [site visited Jul. 2, 2015]. Available from internet, <URL: http://www.puzzlemad.co.uk/2012/04/dancing-with-microcubology.html.
English Abstract for Foreign Reference EP0087624A2, 2 pages.
Mega Bloks Fisher-Price Toddler Block Toys, "Big Building Bag with 80 Pieces and Storage Bag, Blue, Gift Ideas for Kids Age 1+ Years," availabe on the Internet https://www.amazon.com/dp/B007GE75HY/ref=cm_sw_r_api_i_E47B9HE3DKNY49NACJXH_0?_encoding=UTF8&sa-no-redirect=1&th=1, Release date Jun. 1, 2018.
LEGO.com "LEGO® Picture Frame," available on the Internet at https://www.lego.com/en-us/product/lego-picture-frame-5006215, Customer Reviews on this site dated at least as early as 2020.
Brickset—Your Lego(R) Set Guide, "Review: 41914 Creative Picture Frames," available on the Internet at https://brickset.com/article/51611/review-41914-creative-picture-frames, May 29, 2020.

* cited by examiner

STACKABLE PICTURE FRAME FOR COLLAGE

PRIORITY CLAIM

This application claims the priority filing benefit of U.S. Provisional Patent Application No. 63/487,159 filed Feb. 27, 2023 for "Modifiable And Stackable Picture Frame Assembly" of Jomana Malone, hereby incorporated by reference in its entirety as though fully set forth herein.

BACKGROUND

A photo frame arrangement, such as a gallery display, cluster, or "collage" as those terms are used interchangeably herein, allows multiple different pictures to be grouped together, creating more interest for the viewer. The collage, as this term is used herein, may include a number of individually framed photos or other artistic displays that are arranged together to cover all or a part of a wall. The individually framed photos or other artistic displays may be related to one another by topic (e.g., a family vacation), or somewhat or even completely unrelated to one another (e.g., scenery, people, plants, animals, etc.), depending on the design and/or creative desires of the person making the collage.

It can be difficult to assemble a custom collage so that all of the frames making up the collage are properly spaced apart and aligned relative to one another. While pre-assembled collage frames are available, pre-assembled collages are preconfigured and thus cannot be customized, tailored, or modified to suit the individual situation or desire of the person wanting to display the collage on their wall.

DETAILED DESCRIPTION

A stackable picture frame device is disclosed that utilizes stackable frames to form frame assemblies for photographs or other artistic works, that can be combined with other frame assemblies to form a collage. The frames have snap-to-grid characteristics, wherein each frame may be freely positioned (and repositioned) at points where the receiving cavity aligns with and adjoins to the projection on the front-side of a separate frame. This may be accomplished by simply pressing the individual frame components together, and does not require the use of tools to assemble and disassemble the frame devices. The frame devices can be readily assembled and disassembled (e.g., for showing different photographs or artistic works), and arranged and rearranged into different collage patterns.

Figure 1:
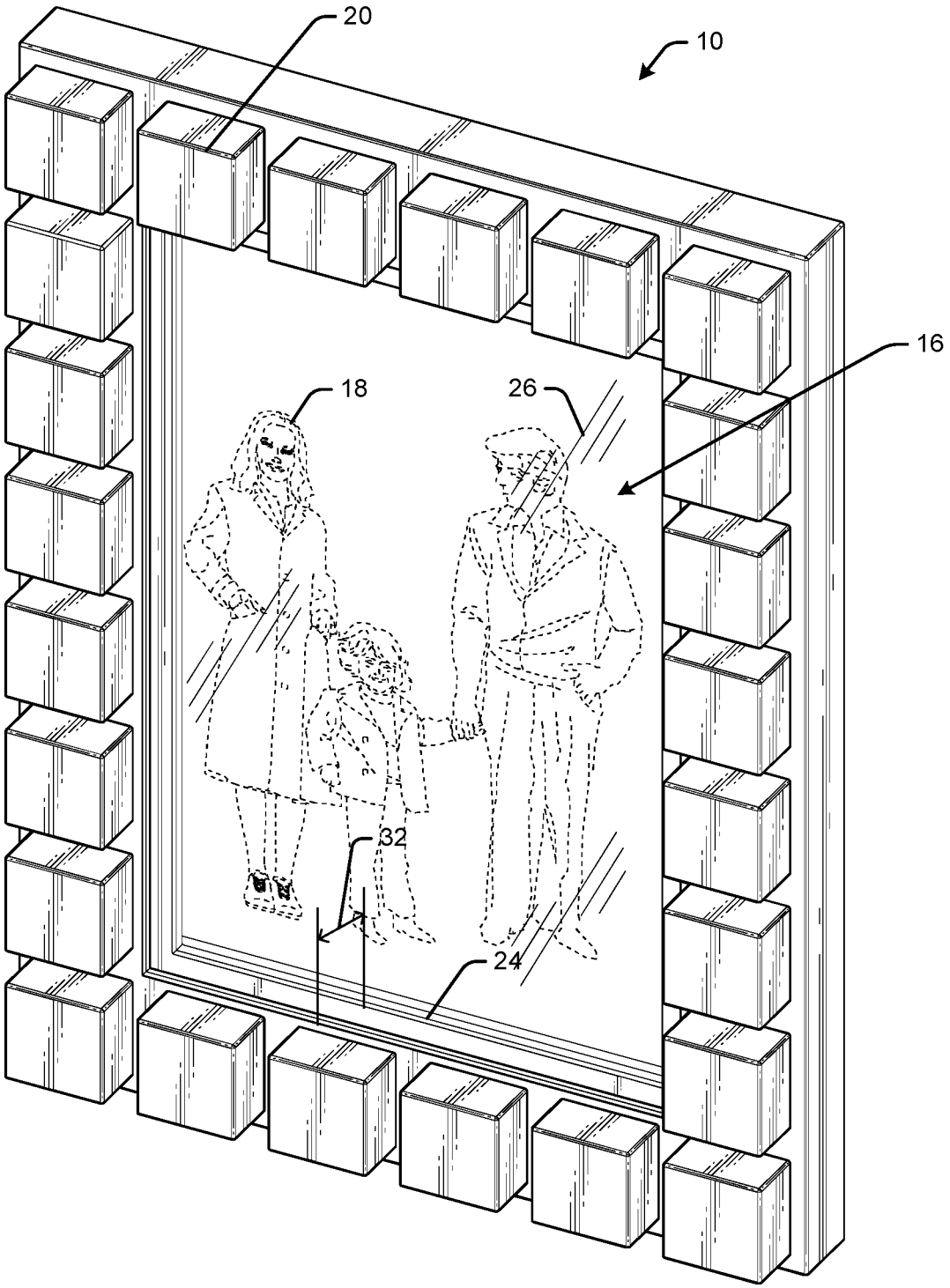
FIG. 1 is a front perspective view of an example stackable picture frame assembly having a single frame body, transparent layer, photograph, and a backing layer.
Figure 8:
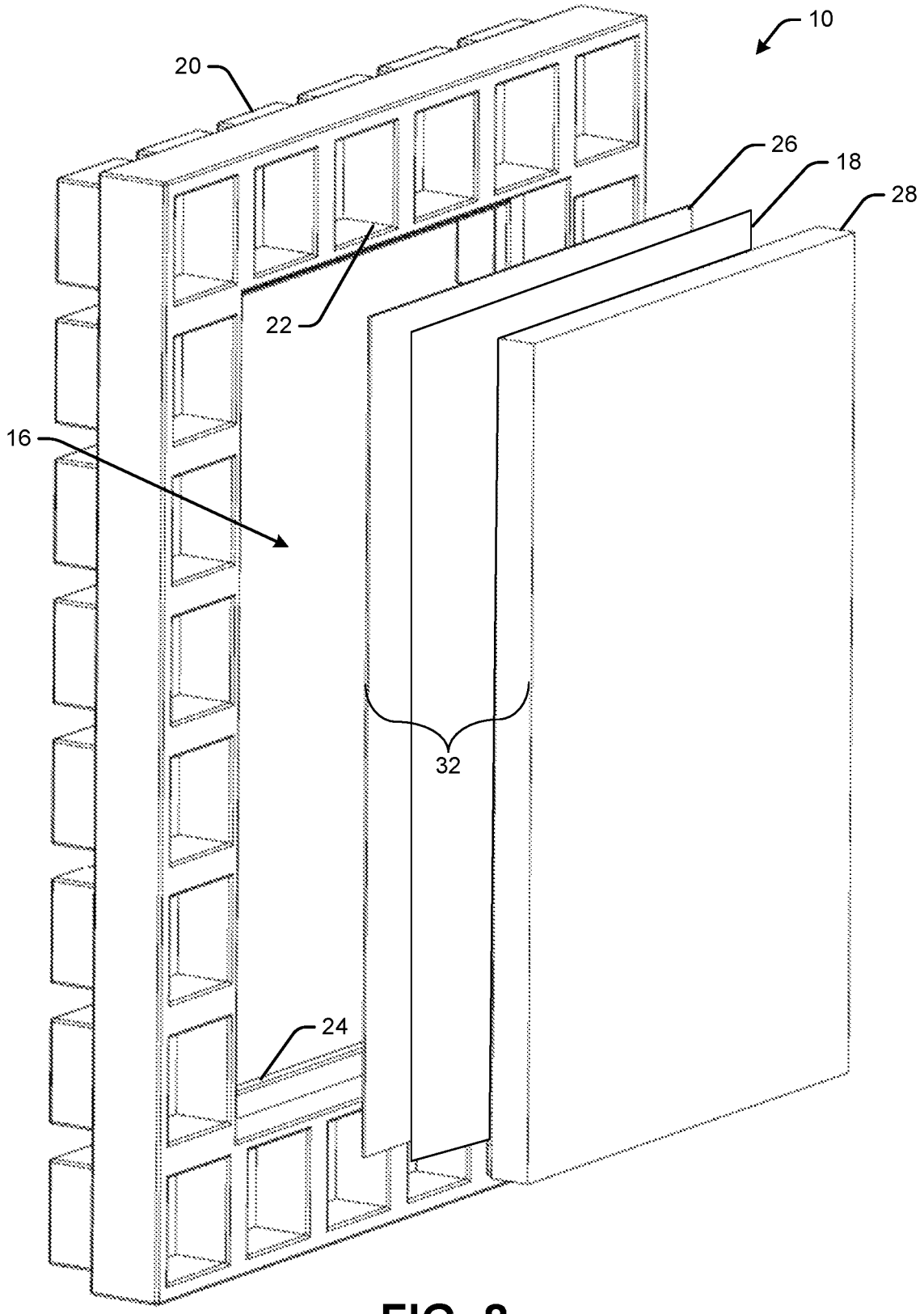
FIG. 8 is a rear perspective view illustrating assembly of the example stackable picture frame to include a photograph.

FIG. 1 is a front perspective view of an example stackable picture frame assembly 10 having a single frame body 12, transparent layer 26, photograph 18, and a backing layer (e.g., layer 28 visible from behind in FIG. 8). The example stackable picture frame device 10 is shown as it includes a first frame body 12. The frame body 12 has an outside perimeter forming a boundary, and an interior area 16 defined by an inside perimeter of the frame body 12. The interior area 16 may be provided for displaying a photograph or artistic work 18.

A plurality of substantially equally spaced projections 20 are formed on a front face of each frame body 12 between the outside perimeter and the inside perimeter. A plurality of substantially equally spaced cavities 22 (see, e.g., FIG. 4) are formed on a back face of each frame body 12. Each of the cavities 22 formed on the back face of each frame body 12 correspond to an individual one of the projections 20 formed on the front face of each frame body 12. The projections 20 formed on the front face of the first frame body 12 are sized to fit within any of the cavities 22 formed on the back face of another frame body to thereby connect at least a part of the first frame 12 body to another frame body to form a collage as will be described in more detail below.

The example stackable frame assembly 10 may secure a photograph or artistic work 18 in place without the need for any additional hardware. The stackable frame assembly 10 may also be pulled apart to remove and replace the photograph or artistic work 18 without needing any hardware.

Figure 11:
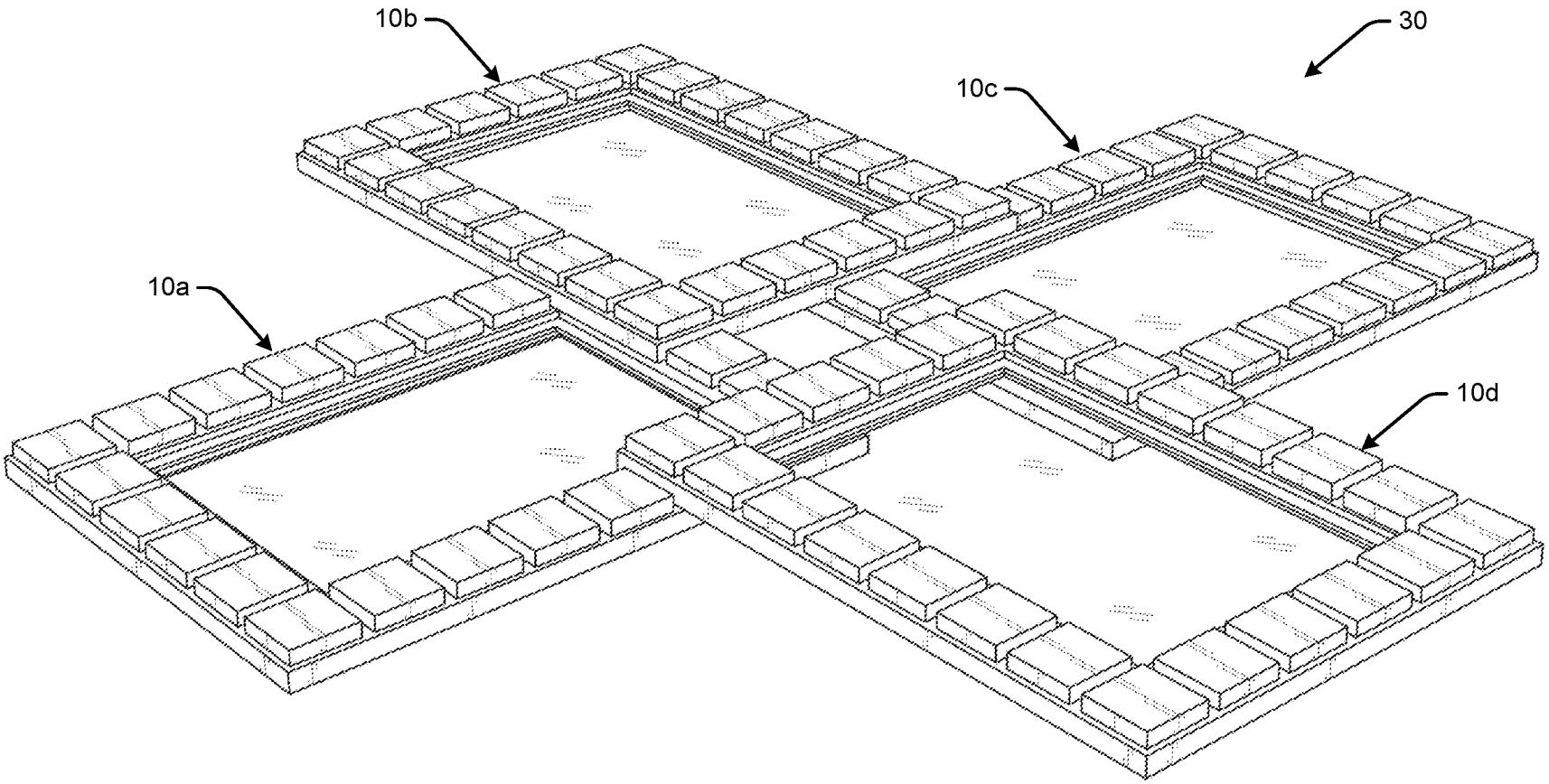
FIG. 11 is a front perspective view showing multiple example stackable picture frame assemblies forming a collage.

In an example, the stackable frame assembly 10 can be assembled in a similar manner with another stackable frame assembly 10 to form a collage 30 (see, e.g., FIG. 11). The frame bodies 12 can easily be pulled apart from one another, rearranged, and pressed back together in a different orientation to form a different collage, without necessitating the use of tools, and without causing damage to the frame bodies 12.

Before continuing, it is noted that as used herein, the terms "includes" and "including" mean, but is not limited to, "includes" or "including" and "includes at least" or "including at least." The term "based on" means "based on" and "based at least in part on."

It is also noted that although a substantially rectangular shape frame body 12 is shown in the drawings, any other suitable shapes may be implemented. Likewise, although substantially rectangular shape protrusions and cavities are shown in some of the drawings, and a substantially cylindrical shape is shown in other drawings, these and any other suitable shapes may be implemented. Providing various shapes will be readily understood by those having ordinary skill in the art after becoming familiar with the teachings herein. The examples described herein are only provided for purposes of illustration, and are not intended to be limiting except as defined in the claims.

The operations shown and described herein are provided to illustrate example implementations. It is noted that the operations are not limited to the ordering shown. Still other operations may also be implemented. Likewise, other devices and/or device configurations may be utilized to carry out the operations described herein.

Figure 2:
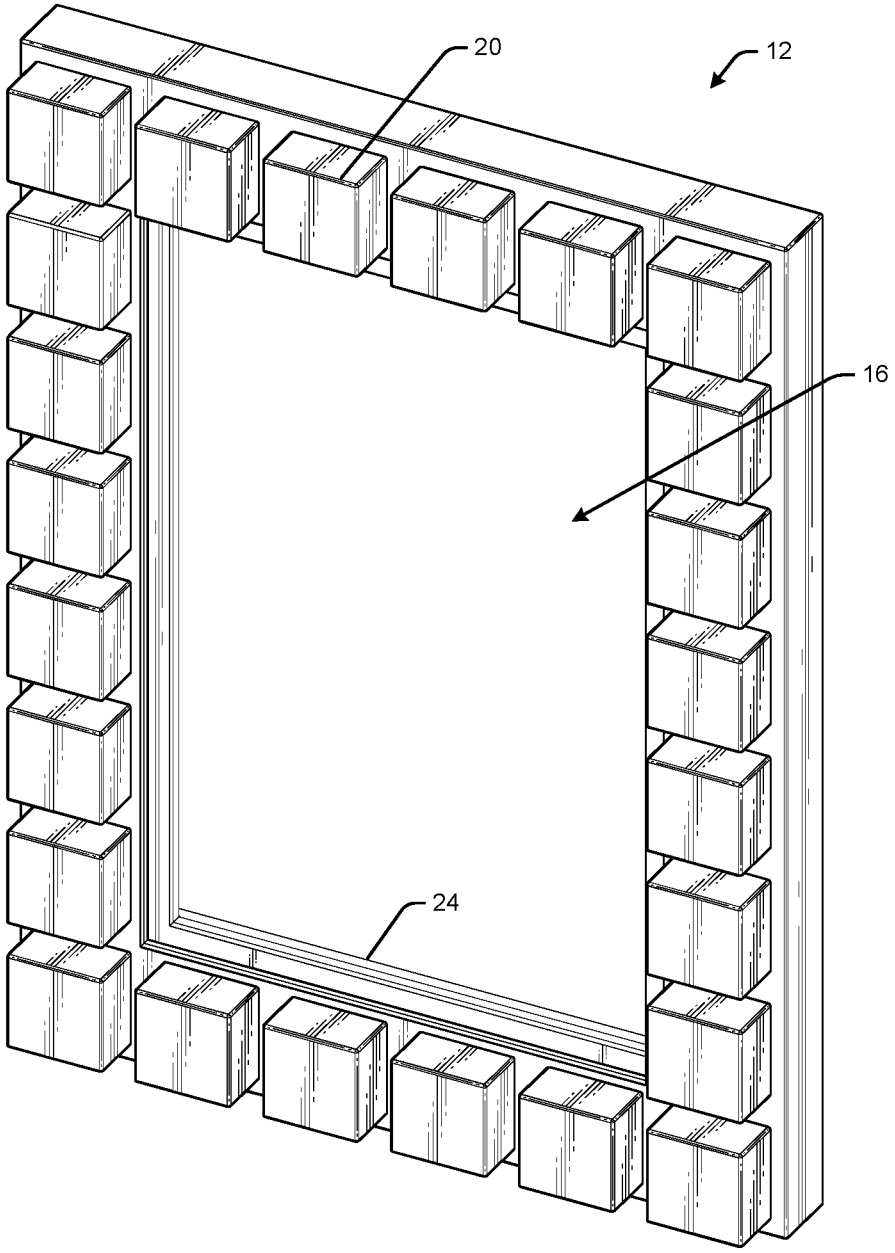
FIG. 2 is a front perspective view of a single frame body for an example stackable picture frame.
Figure 3:
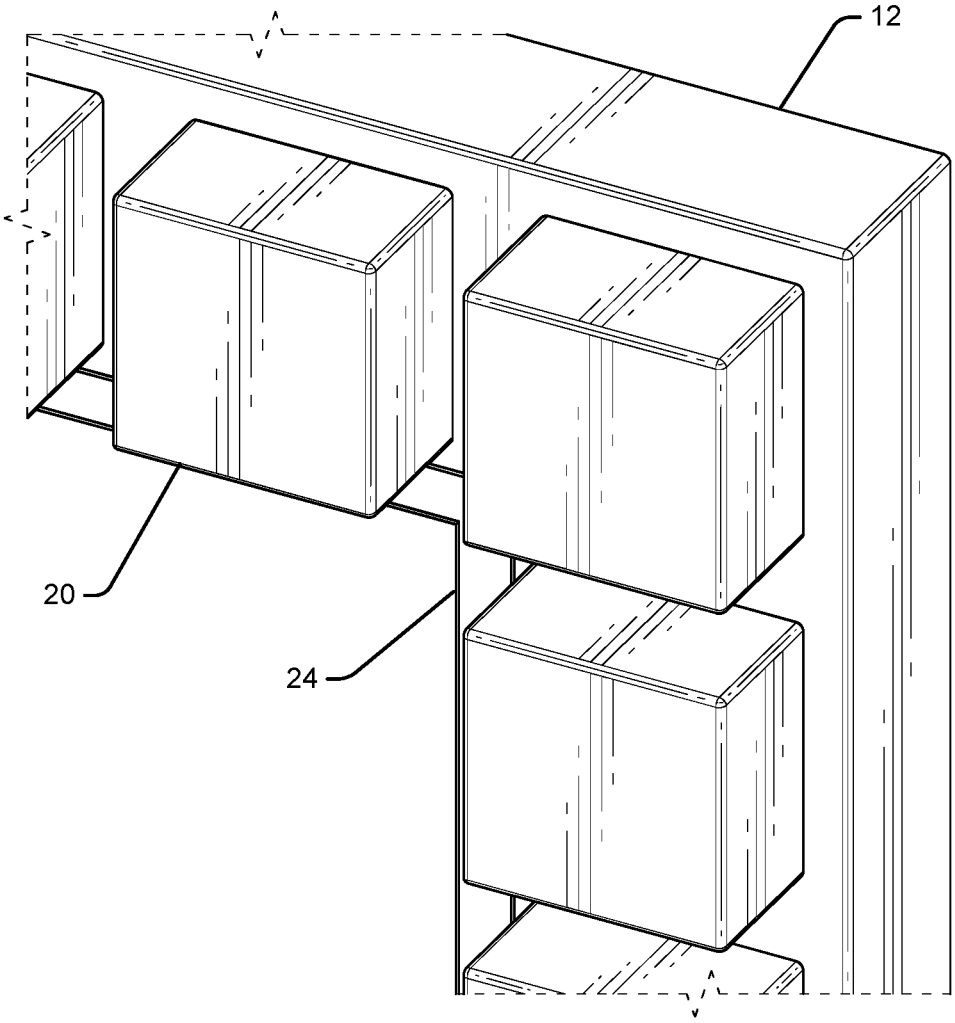
FIG. 3 is a close-up perspective view of a corner of the individual example frame body corresponding to the front perspective view shown in FIG. 2.
Figure 4:
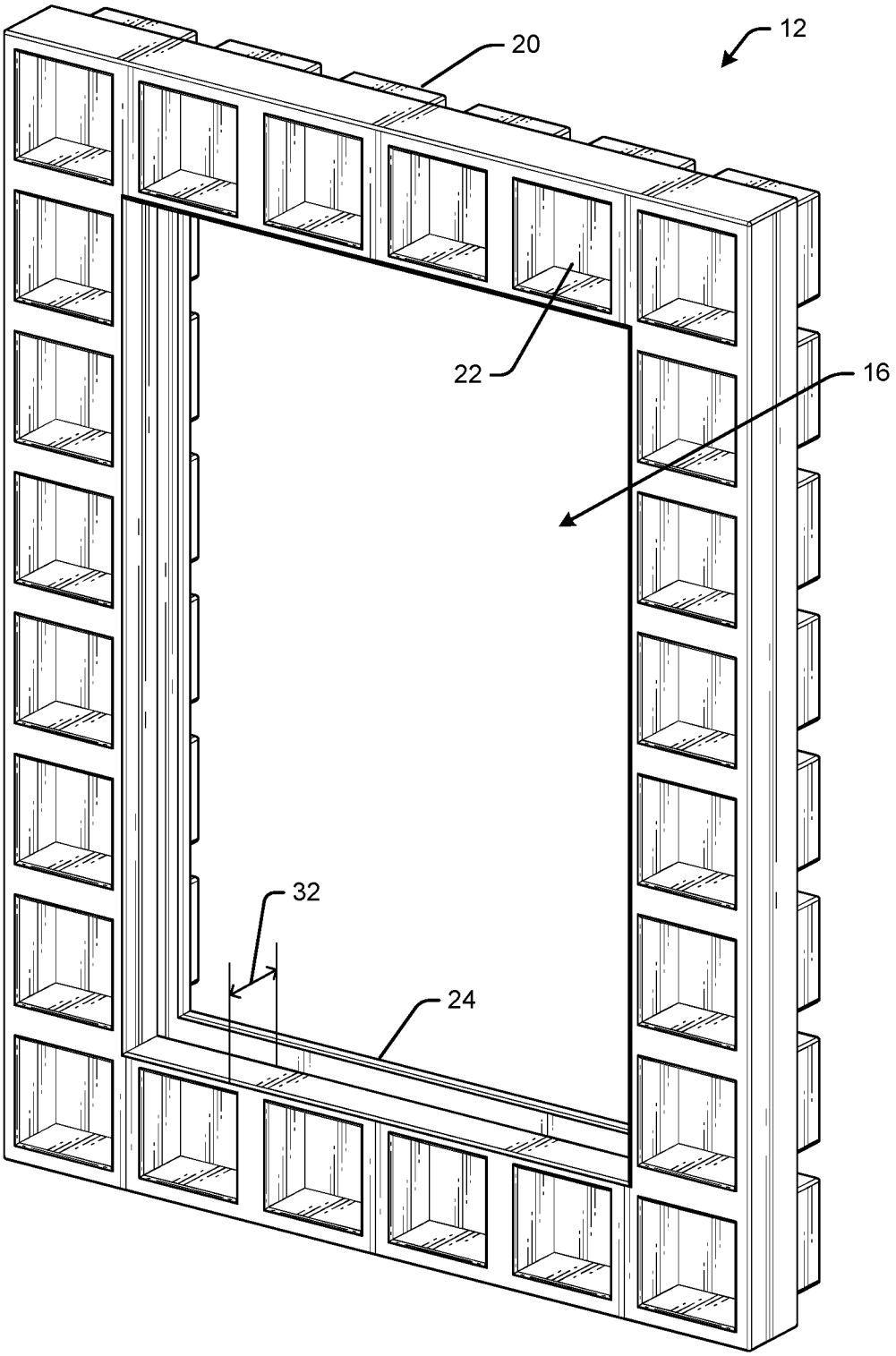
FIG. 4 is a rear perspective view of the individual example frame body shown in FIG. 2.
Figure 5:
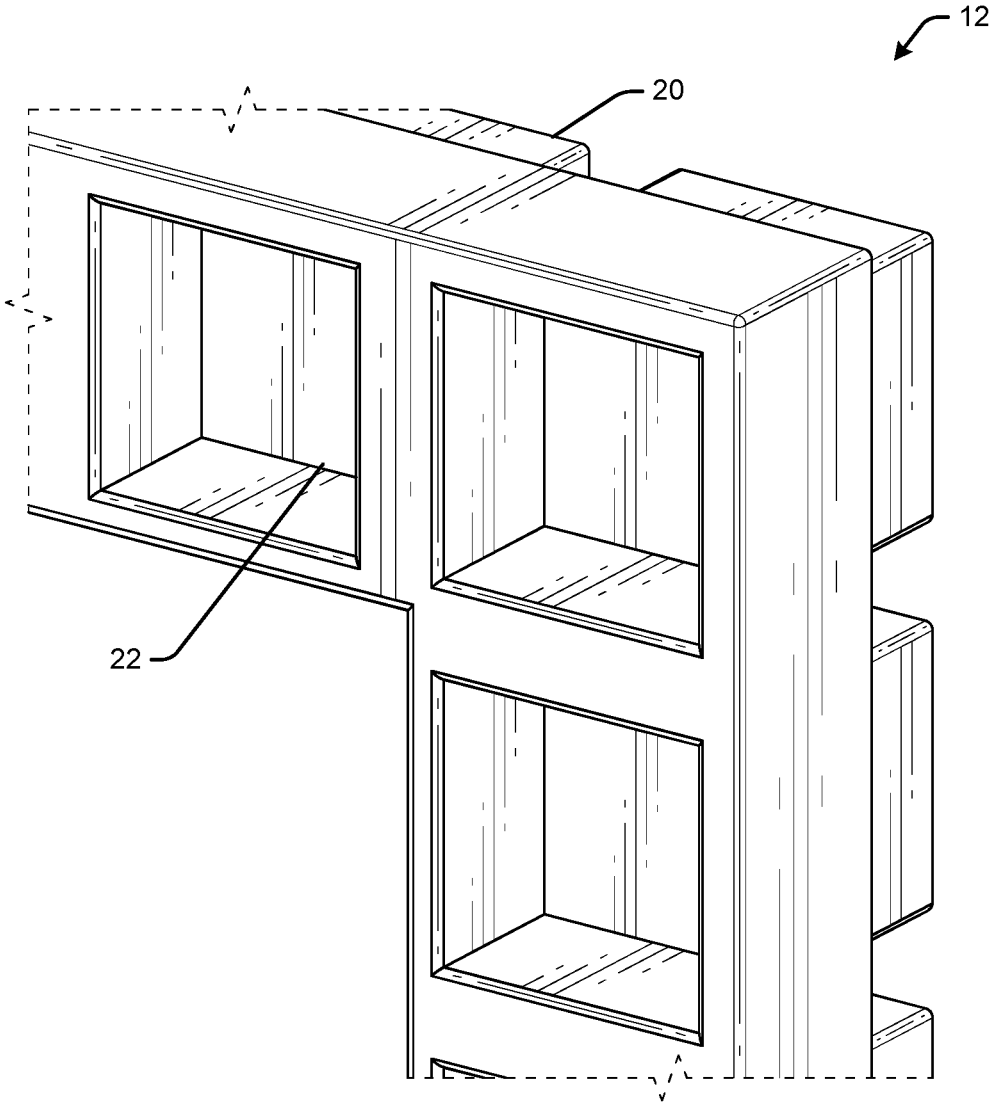
FIG. 5 is a close-up perspective view of a corner of the individual example frame body corresponding to the rear perspective view shown in FIG. 4.
Figure 6:
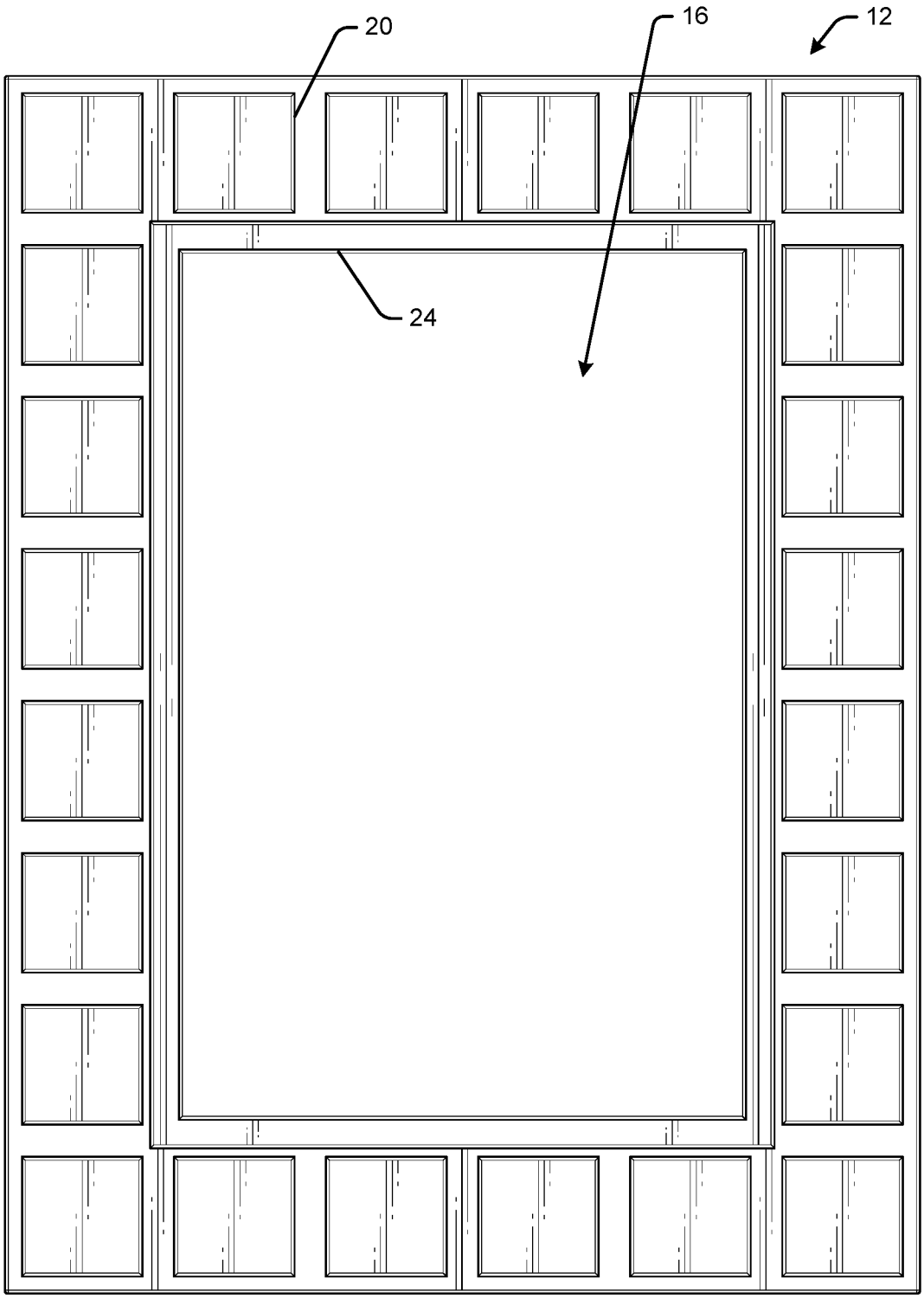
FIG. 6 is a back view of the individual example frame body shown in FIG. 2.
Figure 7:
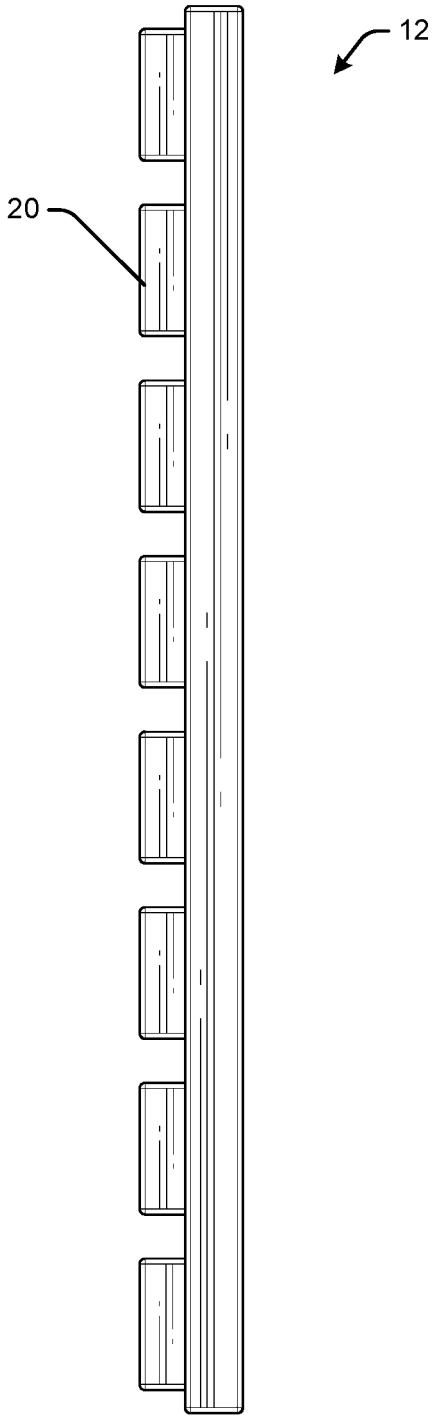
FIG. 7 is a side view of the individual example frame body shown in FIG. 2.

FIG. 2 is a front perspective view of a single frame body for an example stackable picture frame. The frames could come in different sizes. These different sized frames can have a different number of protrusions and cavities. FIG. 3 is a close-up perspective view of a corner of the individual example frame body 12 corresponding to the front perspective view shown in FIG. 2. FIG. 4 is a rear perspective view of the individual example frame body 12 shown in FIG. 2. FIG. 5 is a close-up perspective view of a corner of the individual example frame body 12 corresponding to the rear perspective view shown in FIG. 4. FIG. 6 is a back view of the individual example frame body 12 shown in FIG. 2. FIG. 7 is a side view of the individual example frame body 12 shown in FIG. 2.

In an example, the stackable picture frame device 10 includes a first frame body 12 having an outside perimeter forming a boundary, and an interior area defined by an inside perimeter of the frame body 12. The interior area is provided for displaying a photograph or artistic work. Each frame body 12 has a plurality of substantially equally spaced projections 20 formed on a front face between the outside perimeter and the inside perimeter. Each frame body 12 also has a plurality of substantially equally spaced cavities 22 formed on a back face of each frame body, as seen in FIGS. 4 and 5.

In an example, the projections 20 and the cavities 22 are substantially square or rectangular in shape. However, any suitable shape may be provided, including the cylindrical shaped projections and cavities shown in FIGS. 17-22. Still other shapes may also be provided, such as triangular, hexagonal, octagonal, and oval, to name only a few examples of different shapes that may be suitable.

Each of the cavities 22 correspond to an individual one of the projections 20 formed on the front face of each frame body 12. That is, the cavities 22 are each formed inside of the corresponding projections 20. Accordingly, the projections 20 are configured (e.g., by size and shape) to fit within any of the cavities 22 to thereby connect the first frame body 12 to another frame body to form a collage.

Figure 9:
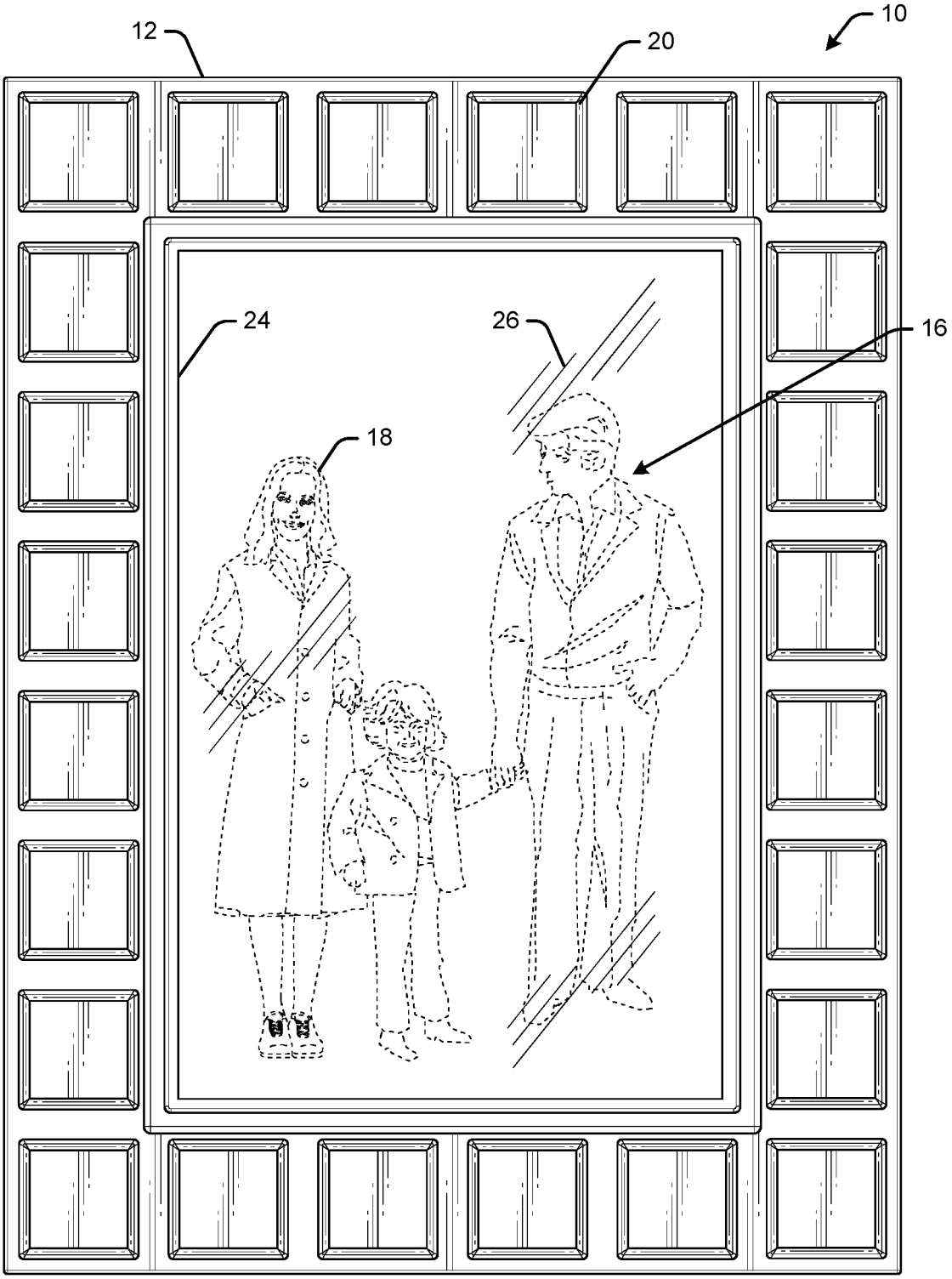
FIG. 9 is a front view showing the example stackable picture frame assembly including a photograph.

FIG. 8 is a rear perspective view illustrating assembly of the example stackable picture frame 10 to include a photograph 18. FIG. 9 is a front view showing the example stackable picture frame including a photograph 18. In an example, the photograph or artistic work is provided behind a semi-transparent or transparent layer 26 (e.g., plastic or glass). The frame body 12 may include a ledge 24 formed along at least part of the inside perimeter of the frame body 12. The ledge retains the photograph or artistic work 18. For example, the ledge can retain the photograph or artistic work 18 between a back side of the ledge 24 of the first frame body 12, and a backing layer 28 (e.g., another glass or acrylic layer, or paper, plastic or cardboard, foam, etc.) to support the photograph 18 therebetween.

In an example, the ledge 24 retains the transparent panel or overlay 26 (e.g., clear plastic or glass) over the photograph or artistic work 18. The backing secures the media elements through pressure and tension between the backing material and the ribs that fall along the inside perimeter on the backside of the frame. The media elements are easily removed by pressing them from the front window of the frame through the back of the frame. There are no tools needed to assemble or disassemble the media elements within the frame.

The ledge 24 can further retain the backing panel 28 behind the photograph or artistic work 18. In an example, a combined thickness of the transparent overlay 26 and the backing panel 28 is substantially equal to a combined distance 32 (shown in FIG. 4 measured between the back side of the ledge 24 of the first frame body 12 and the back surface of the frame body 12). This sizing serves to retain the photograph or other artistic work 18 between the transparent panel or overlay 26 and the backing panel 28 within the frame body 12.

Figure 10:
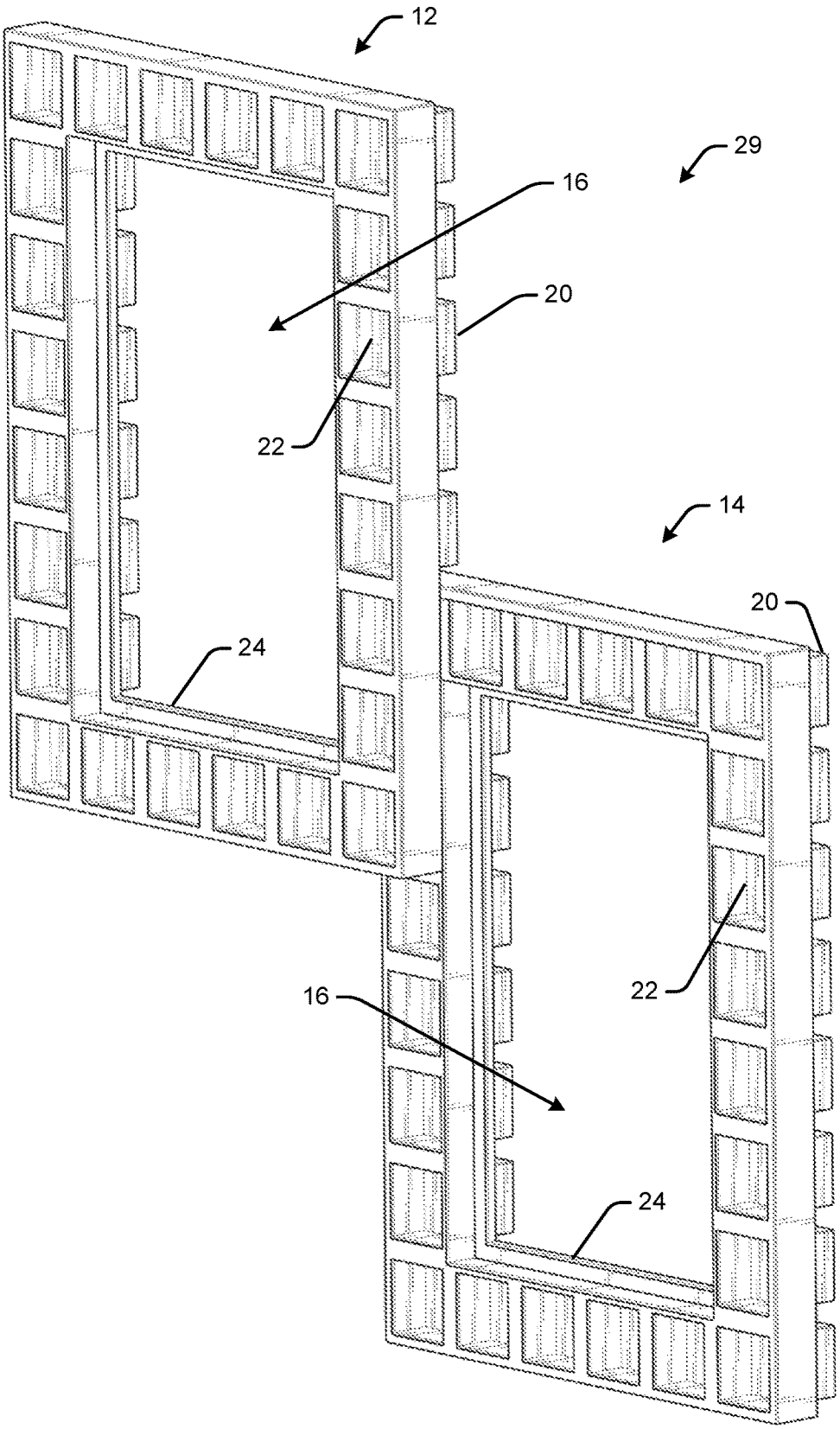
FIG. 10 is a rear perspective view illustrating assembly of multiple example stackable picture frames to form a collage.

In an example, the frame assembly 10 may be positioned over another frame assembly 10 to create a collage 30. FIG. 10 is a rear perspective view illustrating assembly of an example stackable frame 29 which can then be further assembled to form the collage 30 shown in FIG. 11. FIG. 11 is a front perspective view showing multiple example stackable picture frames 10*a-d* forming a collage 30. In an example, the frame bodies are connected to one another by pressing at least some of the equally spaced projections 20 on the first frame assembly 10 into the equally spaced inset cavities 22 of the other frame body. It is noted that although the projections and inset cavities are shown as being generally square in shape, these may be any suitable shape (e.g., round). Indeed, these may even be shaped to mate with projections and/or inset cavities of other products offered by other manufacturers. The frame bodies may also be readily pulled apart and then be repositioned over one another again (e.g., in a different formation) without needing tools.

In an example, the frame assembly 10 may be arranged with multiple other frame assemblies and/or frame bodies 12, together to form the collage 30. The multiple frame assemblies and/or connecting components (e.g., frame bodies 12) can be connected together by pressing at least some of the equally spaced projections 20 on one frame assembly (e.g., 10*a*) into the equally spaced inset cavities 22 of another frame assembly (e.g., 10*b*). In an example, a frame assembly can be formed by securing the transparent material 26, and the photograph 18, by pressing the backing material 28 onto the media elements from the backside of the frame body 12.

In an example, the frames include snap-to-grid characteristics. For example, each frame assembly 10*a-d* may be freely positioned at points where the receiving cavity 22 aligns with and adjoins to the projection 20 on the front-side of a separate frame assembly. These frame assemblies can easily be pulled apart, rearranged, and pressed back together in the same or in a different orientation, or even to multiple different frame components, without damaging the surface of the frames to create any of a wide variety of different shapes and sizes of collages.

In an example, the frame assembly (e.g., 10*a*) enables the attachment on all frame sides, regardless of the size or shape of the other frame assemblies (e.g., 10*b-d*). In an example, the frame assemblies 10*a-d* can be interconnected with other components that are not frame assemblies, such as a square or linear connector (not shown) having the protrusions 20 and cavities 22 for interconnection.

It is noted that it is easy to remove a photograph or other artistic work 18 from one or more of the frame assemblies 10*a-d* (e.g., to update a photograph) even when the frame assemblies 10*a-d* are assembled together as a collage 30, without additional hardware or tools.

Figure 12:
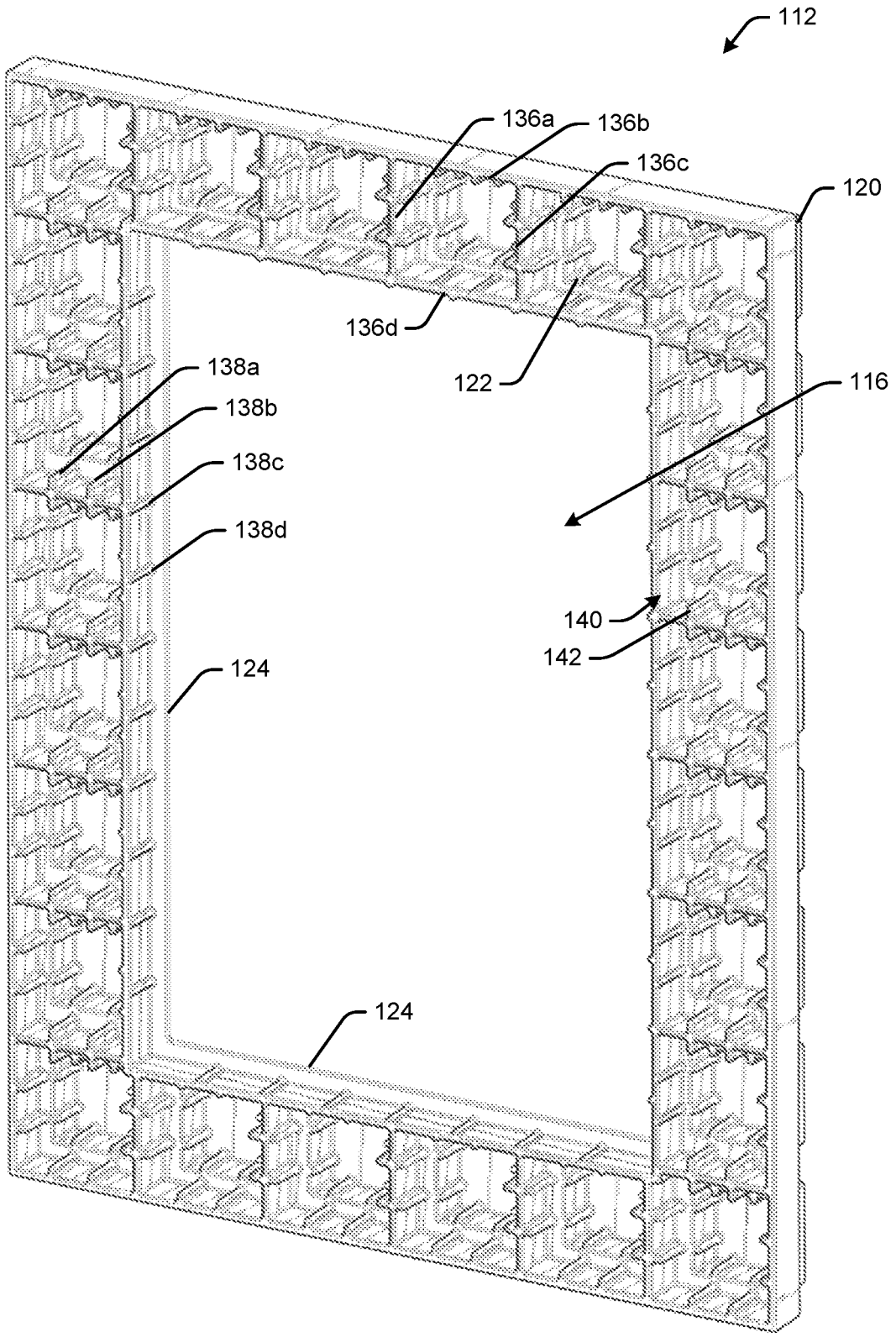
FIG. 12 is a rear perspective view of another individual frame body which may be implemented to form the example stackable picture frame.
Figure 13:
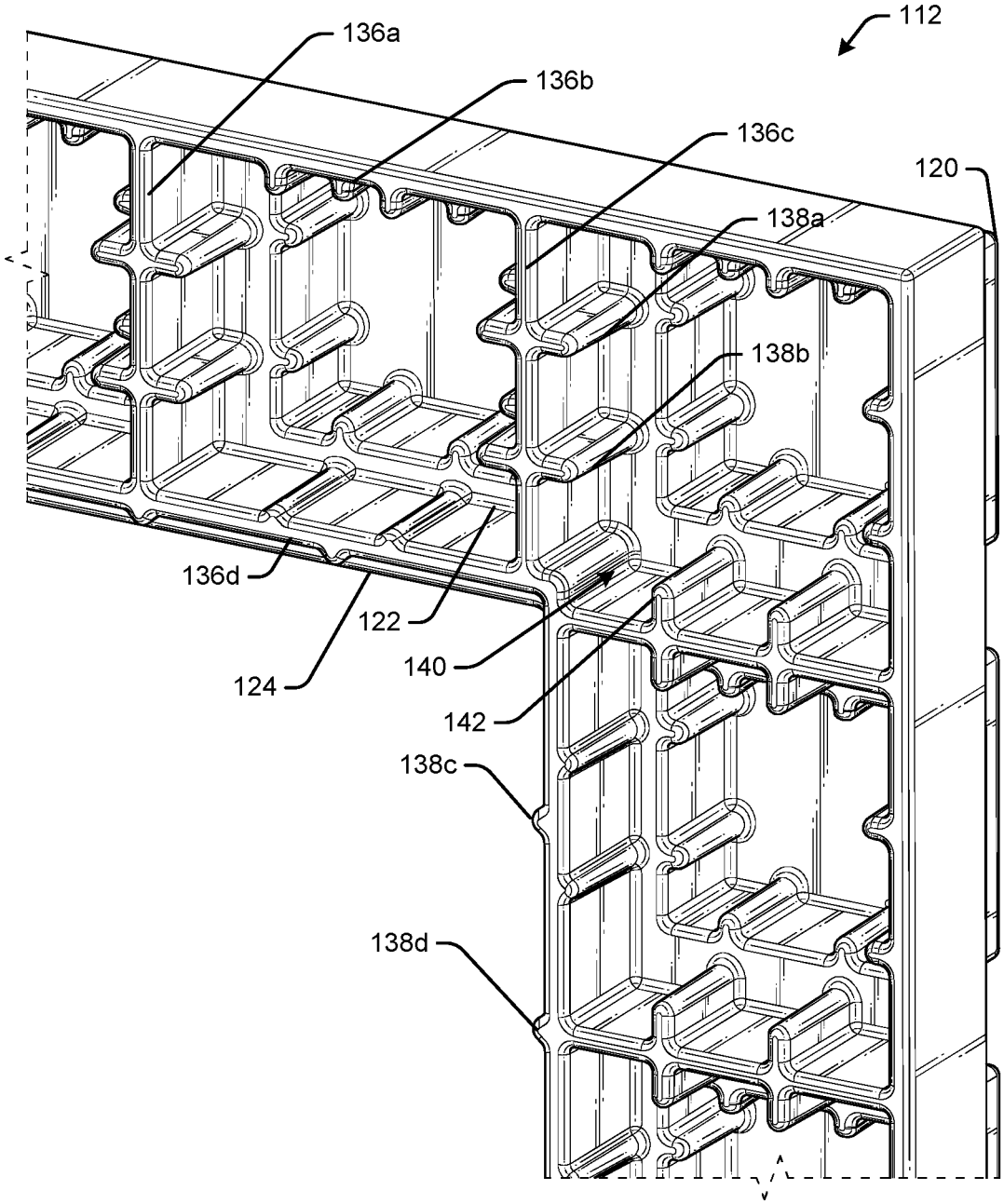
FIG. 13 is a close-up perspective view of a corner of the individual example frame body corresponding to the rear perspective view shown in FIG. 12.
Figure 14:
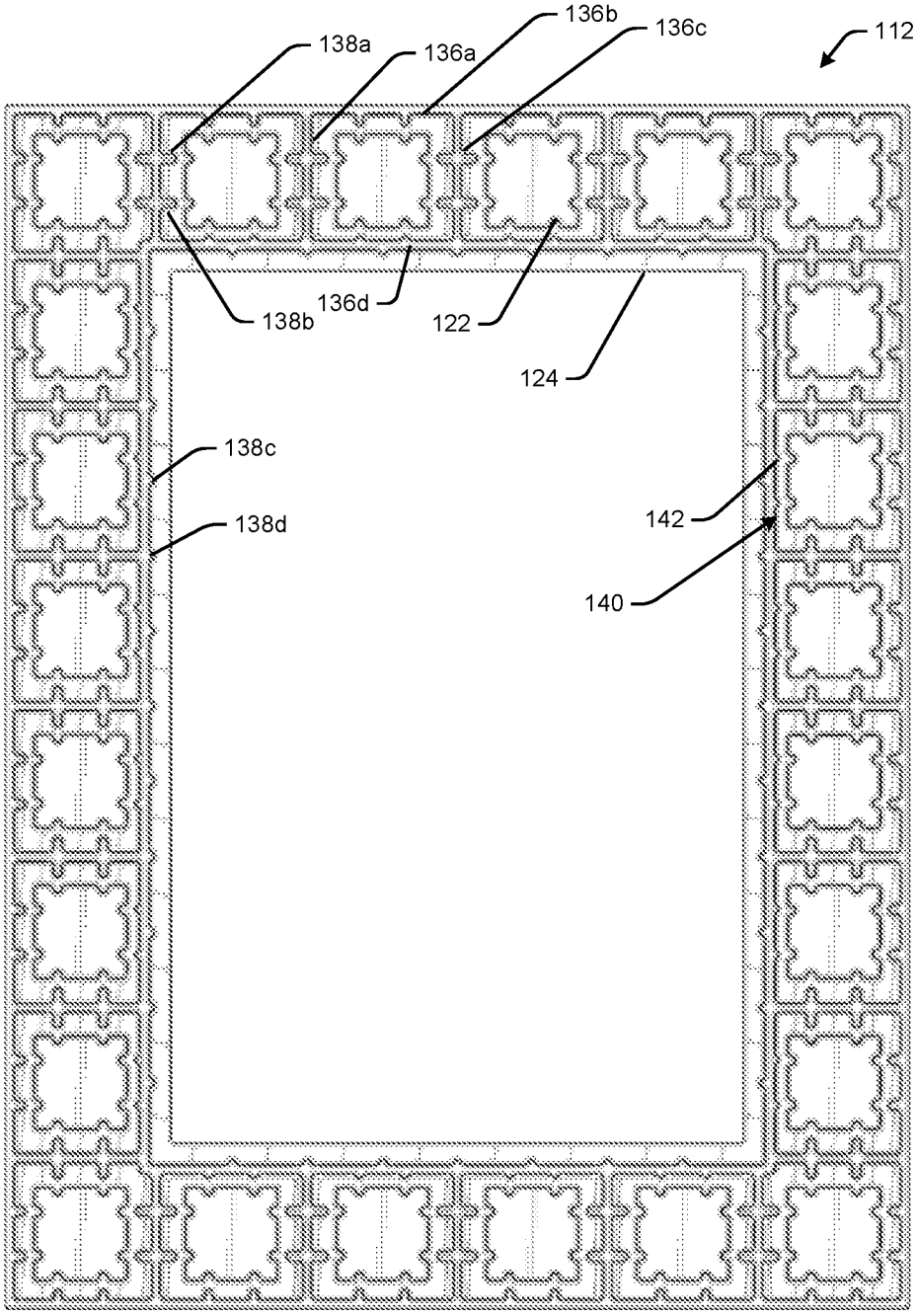
FIG. 14 is a back view of the individual example frame body shown in FIG. 12.

FIG. 12 is a rear perspective view of another individual frame body 112 which may be implemented to form the example stackable picture frame. It is noted that 100-series reference numbers are used to refer to like components already described above; said components not described again here for sake of brevity. It is also noted that the front side of the frame body 112 is the same as the front side of the frame body 12 already described above. That is, frame body 112 has protrusions 120 that are substantially the same as those already shown above for frame body 12. Frame body 112 has different cavities 122. FIG. 13 is a close-up perspective view of a corner of the individual example frame body 112 corresponding to the rear perspective view shown in FIG. 12. FIG. 14 is a back view of the individual example frame body 112 shown in FIG. 12.

In the example shown in FIGS. 12-14, each of the cavities 122 is formed by four sidewalls (e.g., sidewalls 136*a-d*). At least two of the sidewalls (e.g., sidewall 136*a* and 136*d*) separate each cavity 122 from adjacent cavities. At least one of the sidewalls 136*a-d* have at least one structural rib (e.g., ribs 138*a* and 138*b* on sidewall 136*a*) formed thereon. The structural ribs may be provided to strengthen the sidewalls. Structural ribs (e.g., 138*c* and 138*d*) may also be provided on the inside perimeter of the frame body 112, to strengthen the frame body 112 and/or to make selective contact with the transparent overlay 126 and/or the backing 128 (see, e.g., FIG. 15).

In addition, the frame body 112 is shown as it may have a receiving structure 140 within each of the plurality of substantially equally spaced cavities 122 formed on the back face of the frame body 112. The receiving structure 140 is sized to fit the plurality of substantially equally spaced projections 120 formed on the front face of another frame body configured with the protrusions 120. The receiving structure 140 includes a plurality of points of contact 142 configured to contact the projections 120 when the projections 120 of another frame body is assembled to the frame body 112.

Figure 15:
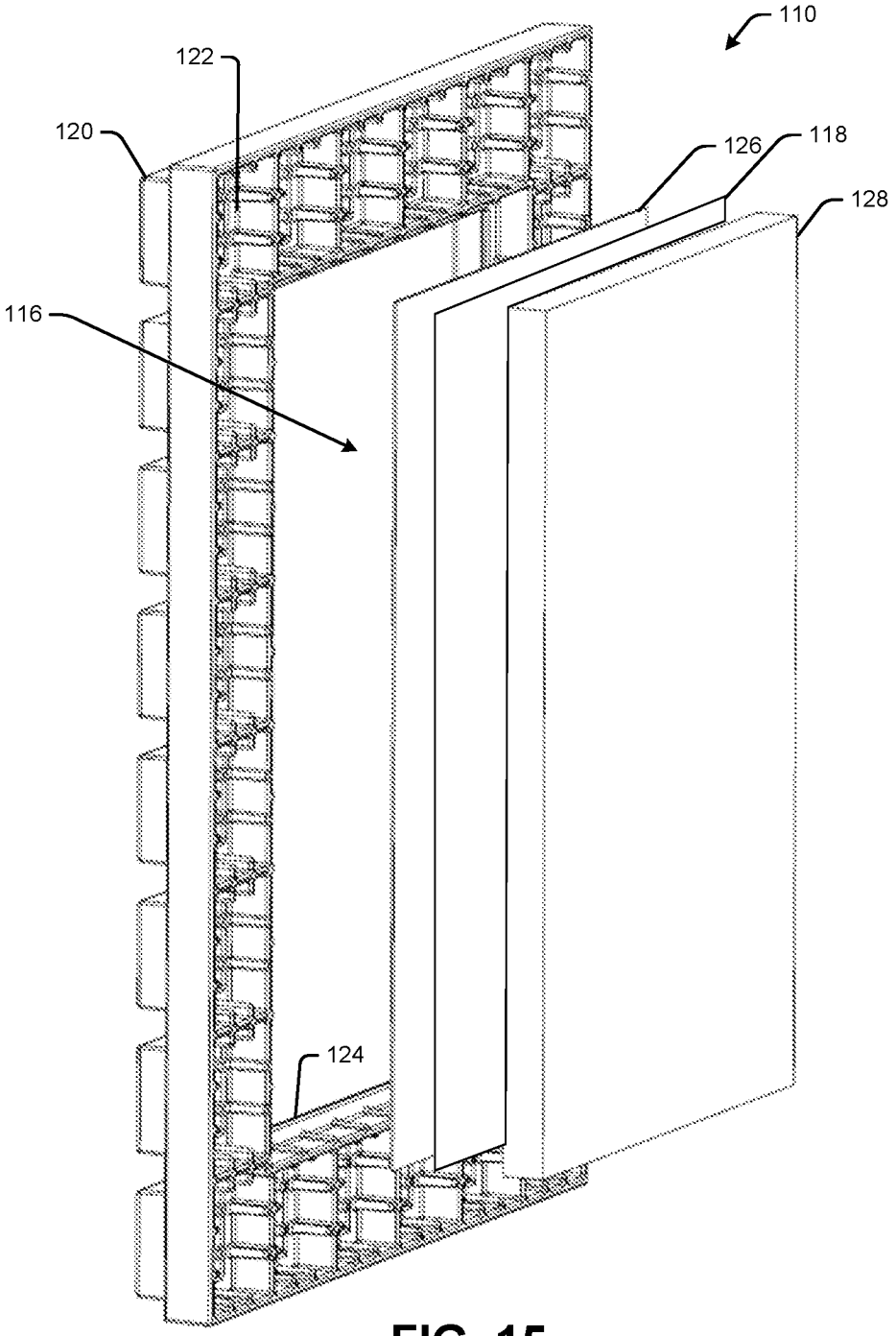
FIG. 15 is a rear perspective view illustrating assembly of the example stackable picture frame corresponding to FIG. 12 to include a photograph.
Figure 16:
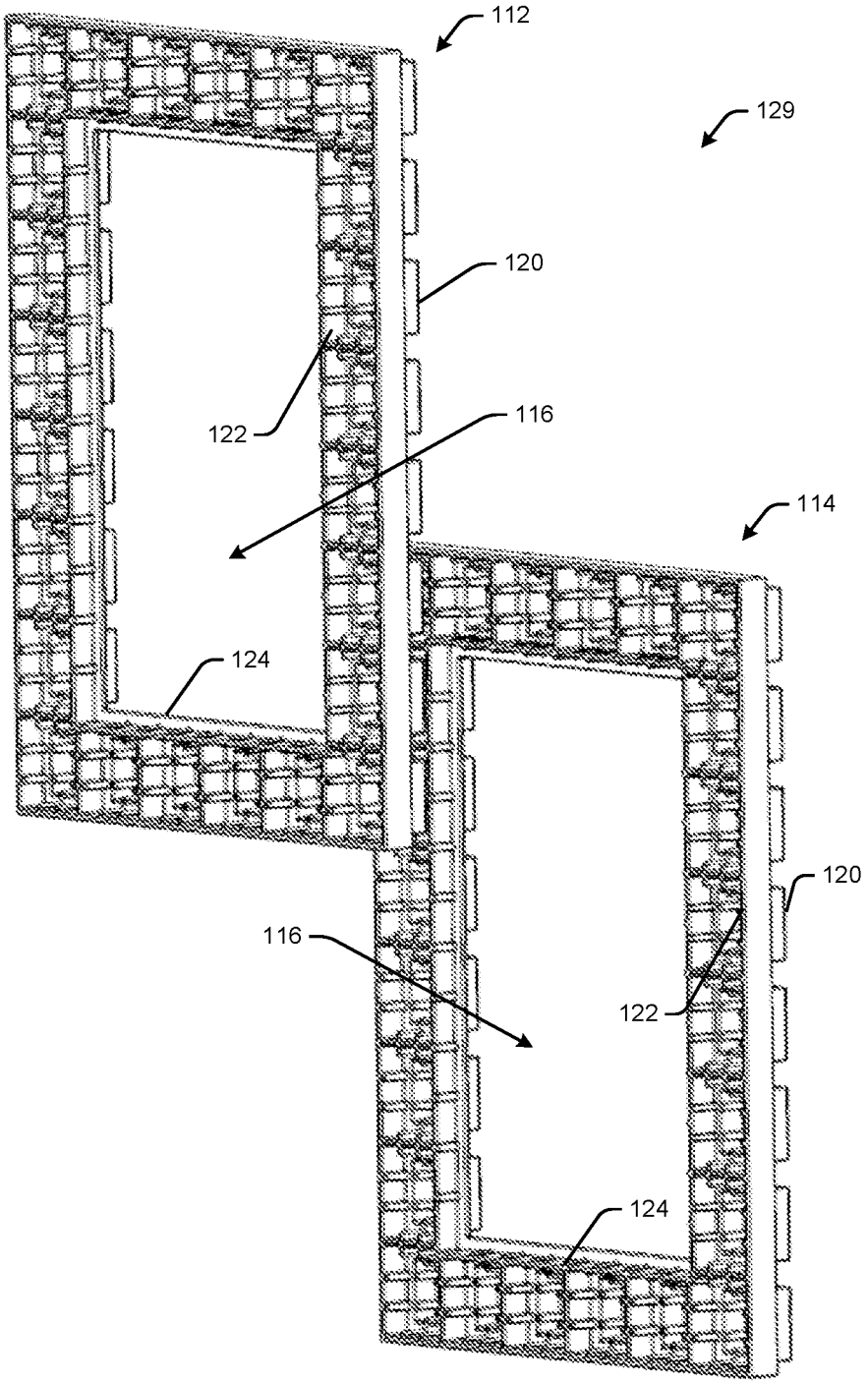
FIG. 16 is a rear perspective view illustrating assembly of multiple example stackable picture frames corresponding to FIG. 12 to form a collage.

FIG. 15 is a rear perspective view illustrating assembly of the example stackable picture frame 110 corresponding to FIG. 12 to include a photograph 118. FIG. 16 is a rear perspective view illustrating assembly of example stackable picture frames 112 corresponding to FIG. 12 which may be assembled together to form a collage.

Figure 17:
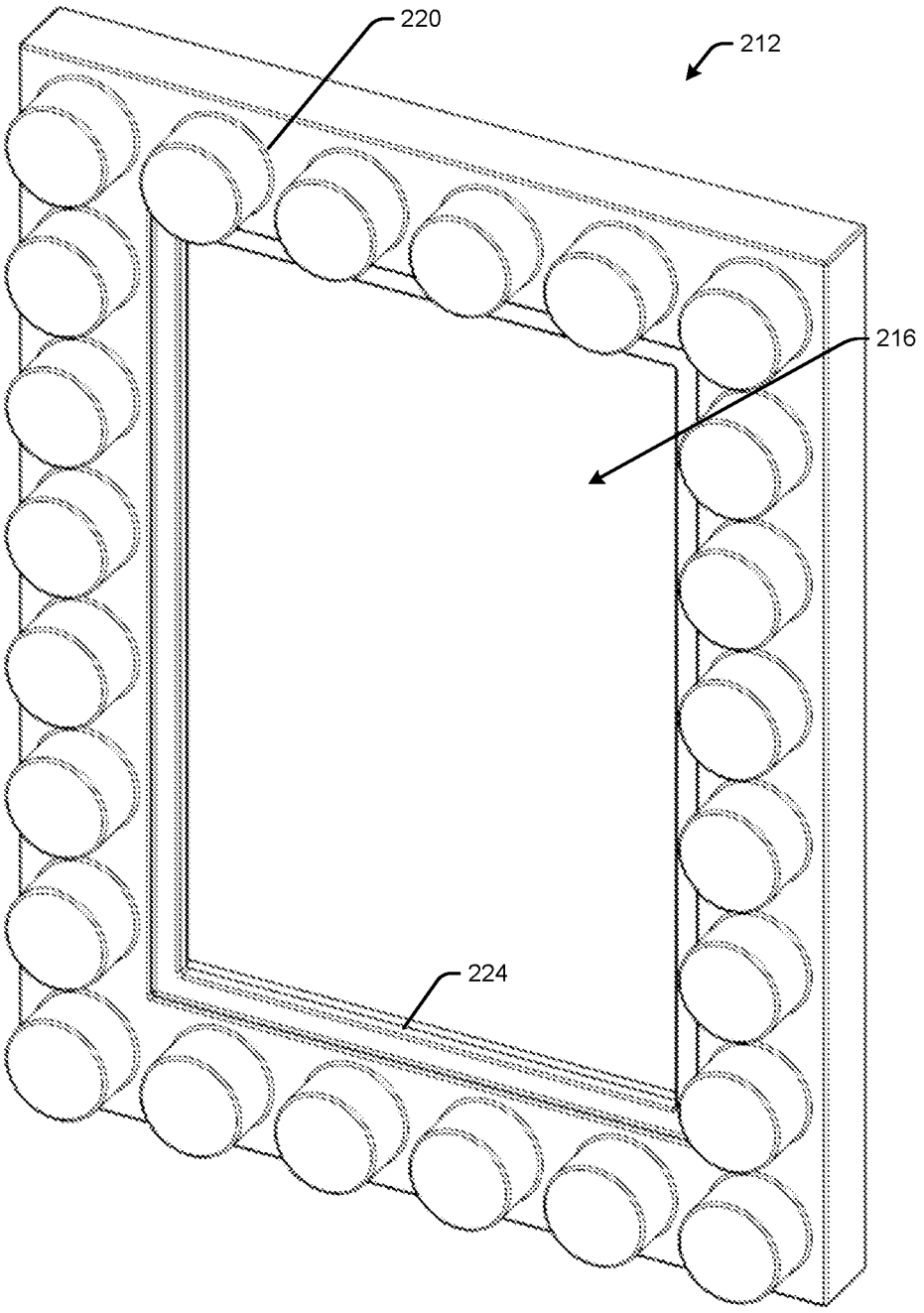
FIG. 17 is a front perspective view of another individual frame body that may be implemented to form the example stackable picture frame.
Figure 18:
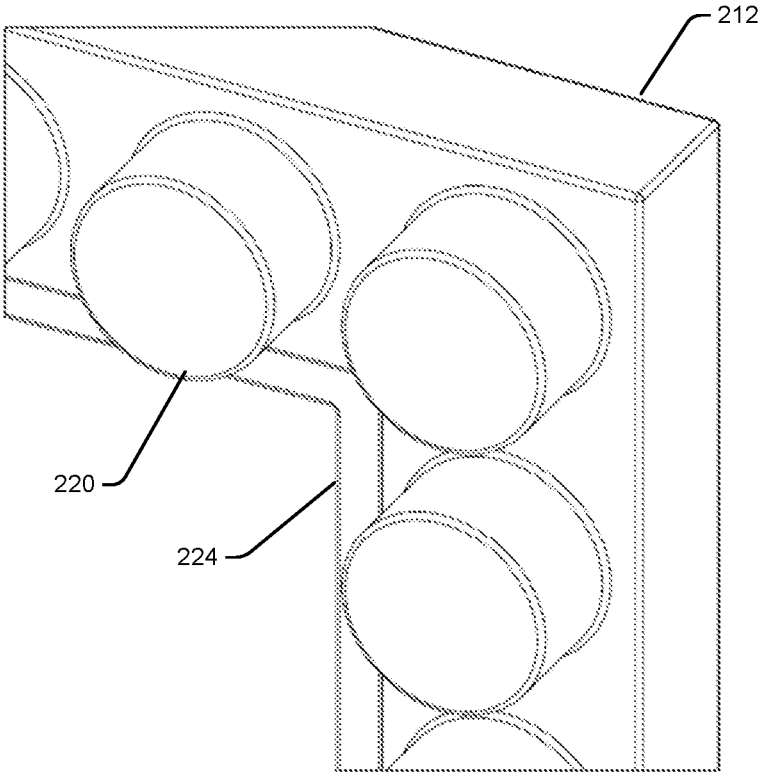
FIG. 18 is a close-up perspective view of a corner of the individual example frame body corresponding to the front perspective view shown in FIG. 17.
Figure 19:
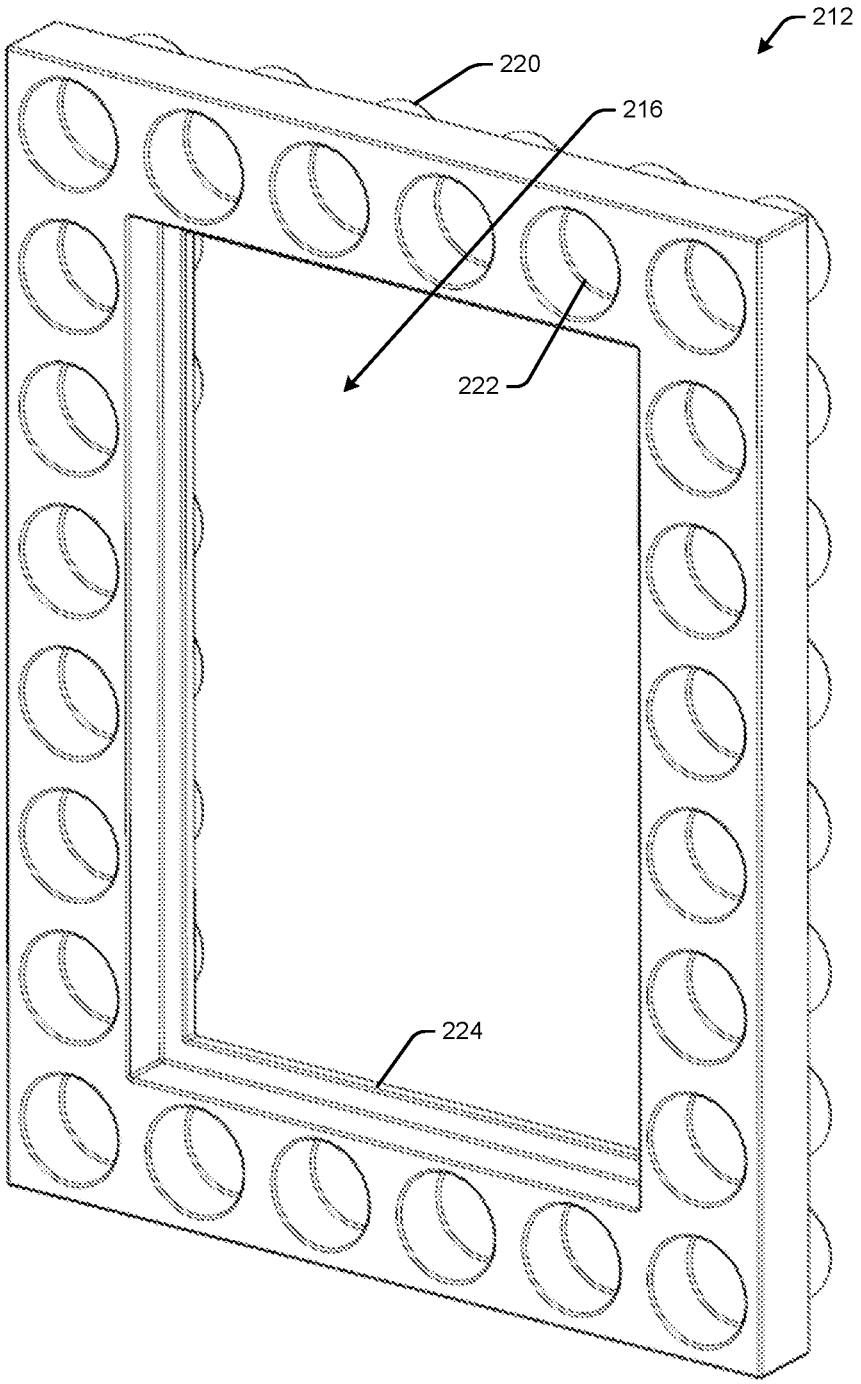
FIG. 19 is a rear perspective view of the individual example frame body corresponding to FIG. 17.
Figure 20:
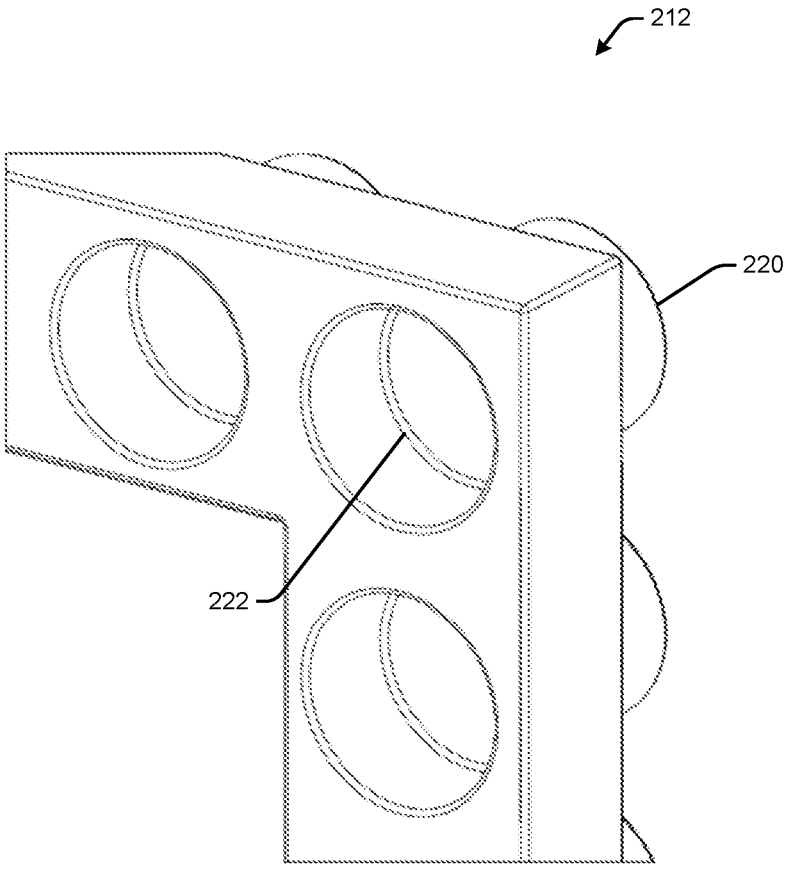
FIG. 20 is a close-up perspective view of a corner of the individual example frame body corresponding to the rear perspective view shown in FIG. 19.

FIG. 17 is a front perspective view of another individual frame body 212 that may be implemented to form the example stackable picture frame. It is noted that 200-series reference numbers are used to refer to like components already described above; said components not described again here for sake of brevity. It is also noted that the front side of the frame body 212 is the same as the front side of the frame body 12 already described above. That is, frame body 212 has protrusions 220 that are substantially the same as those already shown above for frame body 12. Frame body 212 has different cavities 222. FIG. 18 is a close-up perspective view of a corner of the individual example frame body 212 corresponding to the front perspective view shown in FIG. 17. FIG. 19 is a rear perspective view of the individual example frame body 212 corresponding to FIG. 17. FIG. 20 is a close-up perspective view of a corner of the individual example frame body 212 corresponding to the rear perspective view shown in FIG. 19.

The stackable picture frame device in FIGS. 17-20 is shown having substantially equally spaced cylindrical projections or protrusions 220 that extend from the face of the frame body 212 and can be inserted into the back of another frame body through a corresponding inset cavity 222. The frame bodies 212 exhibit snap-to-grid characteristics, wherein each frame body 212 may be freely positioned at points where the receiving cavity 222 aligns with and adjoins to the projection 220 on the front-side of a separate frame body.

The example picture frame assembly 210 may include assembled frame bodies 212 with a perimeter and an interior area for displaying a photograph or other artistic work. Equally spaced projections 220 are formed on a front face around the perimeter of the frame body 212. Corresponding equally spaced inset cavities 222 are also formed on a back face around the perimeter of the frame body 212. Other embodiments may include a mix of protrusions and inset cavities on the front and/or back and/or on the sides of the frame body 212.

Figure 21:
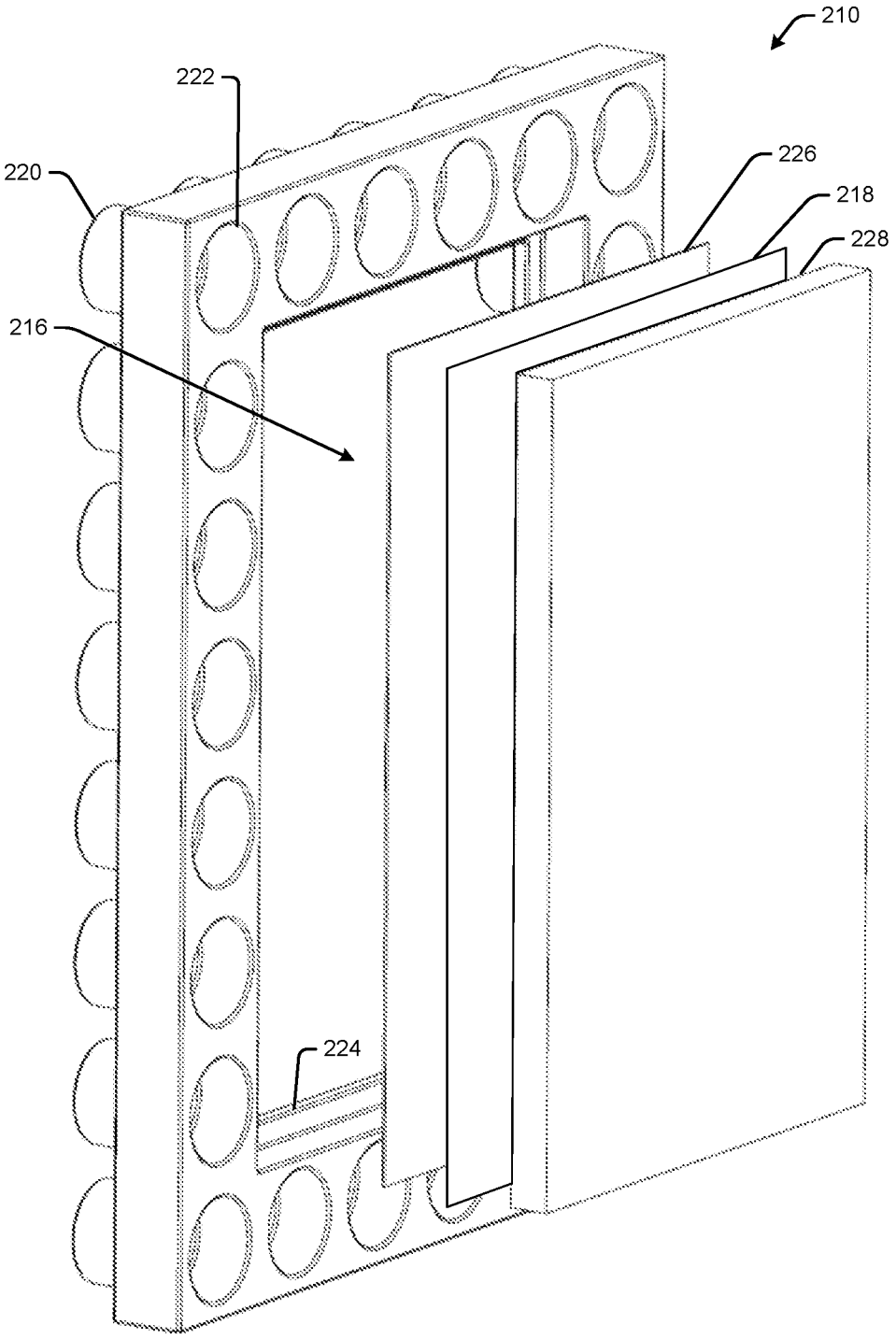
FIG. 21 is a rear perspective view illustrating assembly of the example stackable picture frame corresponding to FIG. 17 to include a photograph.
Figure 22:
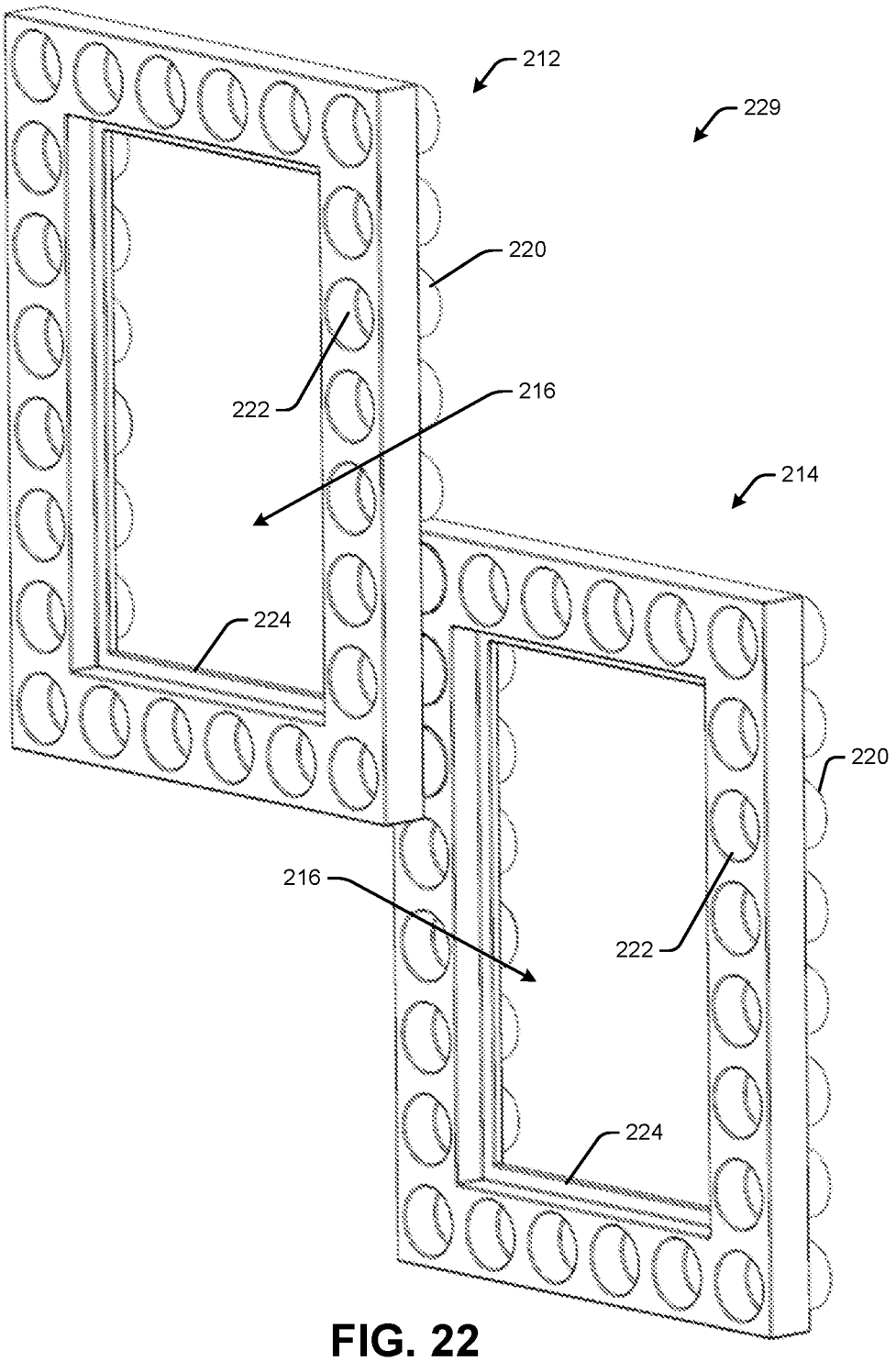
FIG. 22 is a rear perspective view illustrating assembly of multiple example stackable picture frames corresponding to FIG. 17 to form a collage.

FIG. 21 is a rear perspective view illustrating assembly of the example stackable picture frame 210 corresponding to FIG. 17 to include a photograph 218. FIG. 22 is a rear perspective view illustrating assembly of an example stackable picture frames 212 and 214 which may be assembled together to form a collage.

Figure 23:
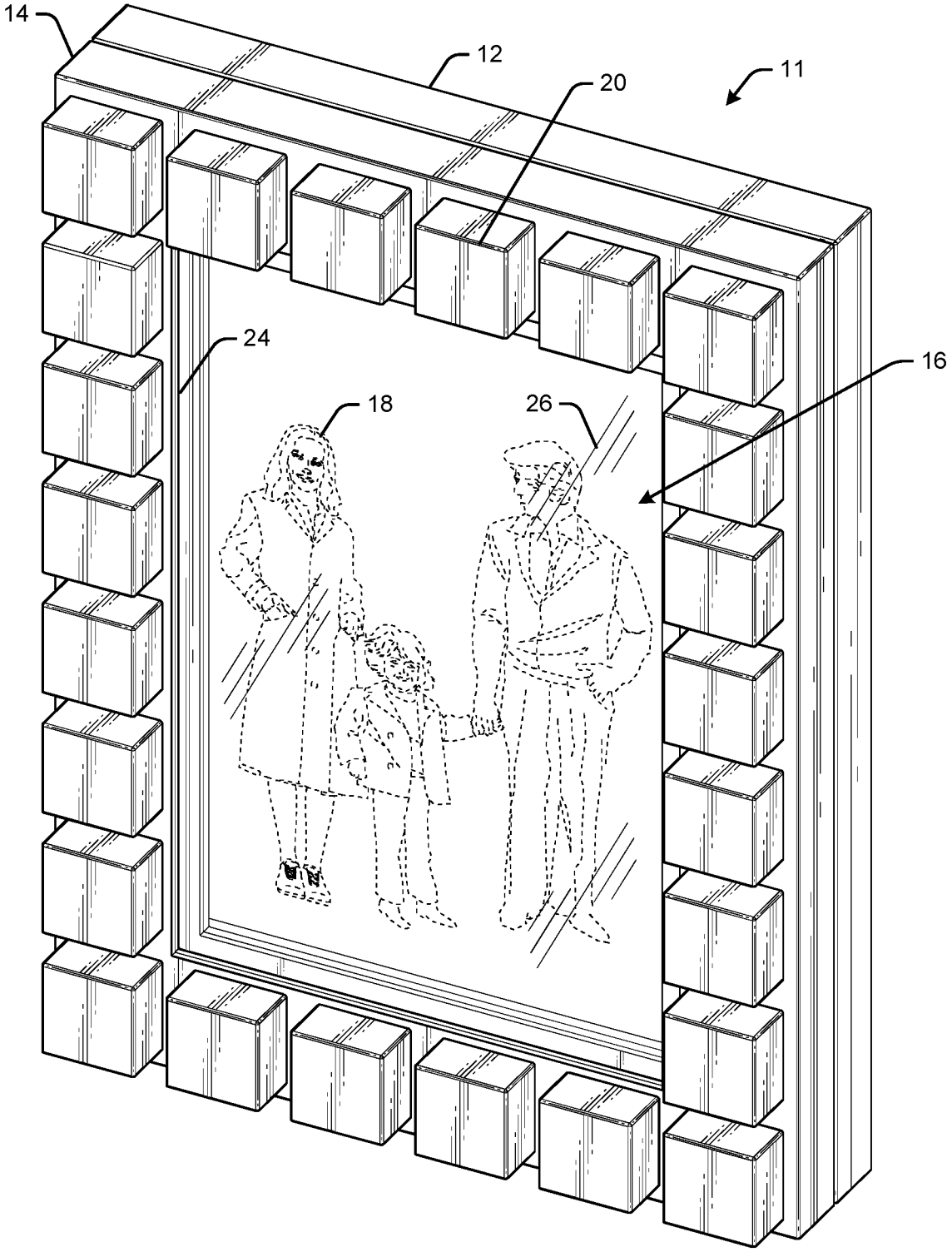
FIG. 23 is a front perspective view of an example stackable picture frame having a double or "sandwiched" frame body.

FIG. 23 is a front perspective view of an example stackable picture frame having double or "sandwiched" frame bodies 12 and 14. It is noted that while the following discussion is with respect to the frame body 12 shown in FIG. 2, the other frame body 14 is substantially the same. Of course, different size and shape frame bodies may be provided for assembling the collage.

The example frame assembly 10 includes frame bodies 12 that can easily be pulled apart, rearranged, and pressed back together in a different orientation and/or to different frame components (e.g., to change color of the frame components), without necessitating tools and without causing damage to the surface of the frames. The example frame assembly 10 can include identical front and back components 12 that, when pressed together, secure a photograph 18 in place without the need for any additional hardware. The frame assembly 10 may also be pulled apart to replace a photograph 18 without needing additional hardware.

It is noted that the examples shown and described are provided for purposes of illustration and are not intended to be limiting. Still other examples are also contemplated.

The invention claimed is:

1. A stackable picture frame device, comprising:

a first frame body and a second frame body, each of the first frame body and the second frame body having an outside perimeter forming a boundary, and an interior area defined by an inside perimeter of the respective frame body, the interior area of each of the frame bodies for displaying a photograph or artistic work;

a plurality of substantially equally spaced projections formed on a front face of each frame body between the outside perimeter and the inside perimeter; and a plurality of substantially equally spaced cavities formed on a back face of each frame body, each of the plurality of substantially equally spaced cavities formed on the back face of each frame body corresponding to an individual one of the plurality of substantially equally spaced projections formed on the front face of each frame body;

wherein the plurality of substantially equally spaced projections formed on the front face of the first frame body are sized to fit within any of the plurality of substantially equally spaced cavities formed on a back face of the second frame body to thereby connect the first frame body to the second frame body to form a collage.

2. The stackable picture frame device of claim 1, wherein the photograph or artistic work is provided between the frame bodies and a backing material for each of the frame bodies.

3. The stackable picture frame device of claim 2, further comprising a ledge formed along at least part of the inside perimeter of the first frame body and the second frame body, the ledge retaining the photograph or artistic work.

4. The stackable picture frame device of claim 2, further comprising a ledge formed along at least part of the inside perimeter of both the first frame body and the second frame body, the ledge retaining the photograph or artistic work behind a back side of the ledge of each frame body.

5. The stackable picture frame device of claim 4, wherein the ledge further retains a transparent panel over the photograph or artistic work.

6. The stackable picture frame device of claim 5, wherein the ledge further retains a backing panel behind the photograph or artistic work.

7. The stackable picture frame device of claim 6, wherein a combined thickness of the transparent overlay and the backing panel is substantially equal to a distance measured between the back side of the ledge of the frame bodies and a back surface of the frame bodies.

8. The stackable picture frame device of claim 1, wherein the first frame body including the photograph or artistic work, a transparent panel, and a backing material, together form a frame assembly.

9. The stackable picture frame device of claim 8, wherein a plurality of frame assemblies are interconnected to form a collage.

10. The stackable picture frame device of claim 1, wherein the plurality of substantially equally spaced projections formed on the front face of each frame body and the plurality of substantially equally spaced cavities formed on the back face of each frame body are substantially square in shape.

11. The stackable picture frame device of claim 1, wherein the plurality of substantially equally spaced projections formed on the front face of each frame body and the plurality of substantially equally spaced cavities formed on the back face of each frame body are substantially cylindrical in shape.

12. The stackable picture frame device of claim 1, further comprising a receiving structure within the plurality of substantially equally spaced cavities formed on the back face of the second frame body, the receiving structure sized to fit the plurality of substantially equally spaced projections formed on the front face of the first frame body.

13. The stackable picture frame device of claim 12, wherein the receiving structure includes a plurality of points of contact configured to contact the projections.

14. The stackable picture frame device of claim 1, wherein each of the cavities is formed by four sidewalls, at least two of the four sidewalls separating each cavity from adjacent cavities, and at least one of the four sidewalls having at least one structural rib formed thereon to strengthen at least one of the four sidewalls.

15. A stackable picture frame device for forming a collage of photographs and/or artistic works, comprising:

a first frame body and a second frame body, each of the first frame body and the second frame body having an outside perimeter forming a boundary, and an interior area defined by an inside perimeter of the respective frame body, the interior area for displaying a photograph or artistic work;

a plurality of substantially equally spaced projections formed on a front face of each frame body between the outside perimeter and the inside perimeter; and a plurality of substantially equally spaced cavities formed on a back face of each frame body, each of the plurality of substantially equally spaced cavities formed on the back face of each frame body corresponding to an individual one of the plurality of substantially equally spaced projections formed on the front face of each frame body;

wherein the plurality of substantially equally spaced projections formed on the front face of the first frame body are sized to fit with an interference fit within any of the plurality of substantially equally spaced cavities formed on a back face of the second frame body to thereby connect the first frame body to the second frame body;

wherein the photograph or artistic work is provided in each of the first frame body and the second frame body with a backing material to form a frame assembly;

wherein a plurality of frame assemblies are interconnected to form the collage of photographs and/or artistic works.

16. The stackable picture frame device of claim 15, further comprising a ledge formed along at least part of the inside perimeter of both the first frame body and the second frame body, the ledge retaining the photograph or artistic work between a back surface of the ledge and a backing panel.

17. The stackable picture frame device of claim 16, wherein the ledge further retains a transparent panel over the photograph or artistic work and the ledge further retains a backing panel behind the photograph or artistic work.

18. The stackable picture frame device of claim 15, wherein the photograph or artistic work is sandwiched between adjacent frame bodies.

19. The stackable picture frame device of claim 16, wherein a combined thickness of the transparent overlay and the backing panel is substantially equal to a distance measured between the back side of the ledge and a back surface of the respective first and second frame bodies.

20. The stackable picture frame device of claim 15, wherein each of the cavities is formed by at least one sidewall having at least one structural rib formed thereon to strengthen the at least one sidewall.

* * * * *